US006500594B2

(12) United States Patent
Hamano et al.

(10) Patent No.: US 6,500,594 B2
(45) Date of Patent: Dec. 31, 2002

(54) ELECTROPHOTOGRAPHIC DEVELOPER AND PROCESS FOR FORMING IMAGE

(75) Inventors: Hirokazu Hamano, Minamiashigara (JP); Katsumi Daimon, Minamiashigara (JP); Manabu Serizawa, Minamiashigara (JP); Norihito Fukushima, Minamiashigara (JP); Takashi Imai, Minamiashigara (JP); Masanori Ichimura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/978,031

(22) Filed: Oct. 17, 2001

(65) Prior Publication Data

US 2002/0106573 A1 Aug. 8, 2002

(30) Foreign Application Priority Data

Dec. 12, 2000 (JP) ..... 2000-376971

(51) Int. Cl.[7] ..... G03G 9/113

(52) U.S. Cl. ..... 430/109.4; 430/111.35; 430/111.4; 430/99

(58) Field of Search ..... 430/111.35, 111.41, 430/111.4, 109.4, 99

(56) References Cited

U.S. PATENT DOCUMENTS 4,931,375 A * 6/1990 Akimoto et al. ..... 430/109
5,480,756 A * 1/1996 Mahabadi et al. ..... 430/109
6,203,956 B1 * 3/2001 Urano et al. ..... 430/109

FOREIGN PATENT DOCUMENTS

| | | |
|---|---|---|
| JP | B2 56-13943 | 4/1981 |
| JP | B2 62-39428 | 8/1987 |
| JP | B2 63-25335 | 5/1988 |
| JP | A 4-120554 | 4/1992 |
| JP | B2 4-30014 | 5/1992 |
| JP | A 4-239021 | 8/1992 |
| JP | A 5-165252 | 7/1993 |

* cited by examiner

*Primary Examiner*—John Goodrow
(74) *Attorney, Agent, or Firm*—Oliff & Berridge, PLC

(57) ABSTRACT

An electrophotographic developer and a process for forming an image are provided in that the fixing can be conducted at a lower temperature than the conventional technique, and that are excellent in the powder storage stability, the anti-blocking property and the image storage stability after fixing without impairing the density, the coloring property and the transparency of the image after fixing, and further have appropriate electric charging property without any problem of fogging or cloud with excellent maintenance property of electric charge. The electrophotographic developer contains a toner for developing an electrostatic image containing a coloring agent and a binder resin containing, as a main component, a crystalline resin having a melting point of about from 60 to 120° C., and a carrier having a resin film containing a nitrogen-containing resin on a surface thereof. The process for forming an image is carried out by using the electrophotographic developer.

19 Claims, 2 Drawing Sheets

ELECTROPHOTOGRAPHIC DEVELOPER AND PROCESS FOR FORMING IMAGE

BACKGROUND OF THE INVENTION

1. Field of the Invention

The present invention relates to an electrophotographic developer that can be used in an electrophotographic apparatus utilizing an electrophotographic process, such as a duplicator, a printer and a facsimile machine, and a process for forming an image using the electrophotographic developer.

2. Description of the Related Art

Conventional examples of a fixing process of a toner for developing an electrostatic image include a pressure fixing process by using only a pressure roll at an ordinary temperature and a contact heat fixing process using a heating roll, and also an oven fixing process using heating with an oven, a flash fixing process using a xenon lamp, an electromagnetic wave fixing process using microwaves, and a non-contact fixing process, such as a solvent fixing process using vapor of a solvent, and processes using heat, such as an oven fixing process and a contact heat fixing process, are mainly employed from the standpoint of reliability and safety. In particular, the contact heating process using a heating roll or belt is constituted from a heating roll or a heating belt having a heating unit, and a pressure roll or a pressure belt. Fixing is effected by passing a fixing sheet (transfer material) with the toner image surface in contact with the surface of the heating roll or the heating belt under pressure. The process has such characteristics that the fixing can be effected with high heat efficiency at a high rate since the surface of the heating roll or the heating belt and the toner image surface of the fixing sheet are in direct contact with each other, and has been widely employed owing to the characteristics.

In the heat fixing process, shortening of the so-called warm up time, i.e., the time from turning on the power to the fixing device reaching the usable temperature to enable fixing, and reduction in fixing temperature for saving the consumption of energy are demanded. In particular, it is demanded in recent years that electrification to the fixing device is terminated except for the time operation for reducing the consumption of energy, and therefore, fixing at further lower temperature is demanded to reach the temperature of the fixing device to the fixable temperature at once. Furthermore, decrease in fixing temperature is preferred from the standpoint of costs because the printing rage can be increased by decreasing the fixing temperature with the same electric power consumption, and the service life of fixing members, such as a heating roll, in the contact heat fixing process can be prolonged.

However, decrease of the fixing temperature of the toner in the conventional processes brings about decrease of the glass transition point of the toner particles, and therefore the storage stability of the toner cannot be simultaneously established. In order to ensure both the low temperature fixing and the storage stability of the toner at the same time, it is necessary to endow the toner with the so-called sharp melt property, i.e., the viscosity of the toner is quickly decreased in a high temperature region with the glass transition point of the toner maintained at a high temperature.

However, since the resin used in the toner generally has certain widths in glass transition point and molecular weight, it is necessary to endow the sharp melt property that the composition and the molecular weight of the resin are aligned to an extreme extent. In order to obtain such resins, it is necessary to align the molecular weight of the resin by employing a special production process or by treating the resin with chromatography, and in such cases, the production cost of the resin in necessarily increased, and waste resins occur upon production. Therefore, it is not preferred from the standpoint of resource saving and environmental protection in recent years.

It has been studied to realize the low temperature fixing property that a crystalline resin is used as the binder resin of the toner (JP-B-56-13943, JP-B-62-39428, JP-B-63-25335, JP-B-62-39428, JP-B-4-30014, JP-A-4-120554, JP-A-4-239021 and JP-A-5-165252). When a crystalline resin is used, the hardness of the toner is maintained at a temperature lower than the melting point of the crystal, and the viscosity of the toner is suddenly decreased at a temperature exceeding the melting point owing to melting of the crystal, so as to realize the low temperature fixing.

However, the crystalline resin is difficult to retain electric charge in comparison to the conventional amorphous resins, and therefore, in the case where the crystalline resin as the binder resin of the toner, it is difficult to impart sufficient charge amount to the toner.

SUMMARY OF THE INVENTION

The invention has been made in view of the foregoing circumstances and is to solve the problems associated with the conventional art. The invention is to provide an electrophotographic developer and a process for forming an image in that the fixing can be conducted at a lower temperature than the conventional technique, whereby the energy consumption on the fixing step is greatly decreased, and the warm up tome is shortened.

The invention is to also provide an electrophotographic developer and a process for forming an image that are excellent in the powder storage stability, the anti-blocking property and the image storage stability after fixing without impairing the density, the coloring property and the transparency of the image after fixing.

The invention is to further provide an electrophotographic developer and a process for forming an image having appropriate electric charging property without any problem of fogging or cloud and being excellent in maintenance property of electric charge.

According to an aspect, the invention relates to an electrophotographic developer containing a toner for developing an electrostatic image and a carrier. The toner contains a colorant and a binder resin that contains a crystalline resin having a melting point of about from 60° C. to 120° C. as a main component. The carrier has a resin coating containing a nitrogen-containing resin.

According to the invention, fixing can be attained at a low temperature by using the crystalline resin having an appropriate melting point as the main component of the binder resin, so as to provide an electrophotographic developer excellent in the powder storage stability, the anti-blocking property and the image storage stability after fixing. Furthermore, a carrier having the resin film containing a nitrogen-containing resin on the surface thereof is combined with the crystalline resin, which is generally short in charging property, so as to remarkably improve the charging property, whereby the electrophotographic developer of the invention has good charging property as an entire electrophotographic developer.

In the electrophotographic developer of the invention, the carrier preferably has a nitrogen content on a surface thereof of about from 0.1 to 50% by atom, and the resin film on the surface of the carrier preferably contains at least one of a urea resin, a urethane resin, a melamine resin and an amide resin.

In the electrophotographic developer of the invention, the crystalline resin in the toner is preferably a crystalline polyester, and more preferably an aliphatic crystalline polyester. In the case where the crystalline polyester is used as the crystalline resin, it is preferred that the crystalline polyester is synthesized from an acid component and an alcohol component, with at least one of the acid component and the alcohol component containing a component containing a sulfonic acid group.

According to another aspect, the invention relates to a process for forming an image containing the steps of: forming an electrostatic latent image on a latent image bearing member; developing the electrostatic latent image formed on the latent image bearing member with a developer carried on a developer bearing member to form a toner image; transferring the toner image formed on the latent image bearing member to a transfer material; and fixing the toner image transferred to the transfer material with heat, the developer being the electrophotographic developer according to the invention.

BRIEF DESCRIPTION OF THE DRAWINGS

Preferred embodiments of the invention will be described in detail based on the following figures, wherein.

DESCRIPTION OF THE PREFERRED EMBODIMENTS

Electrophotographic Developer

Figure 1:
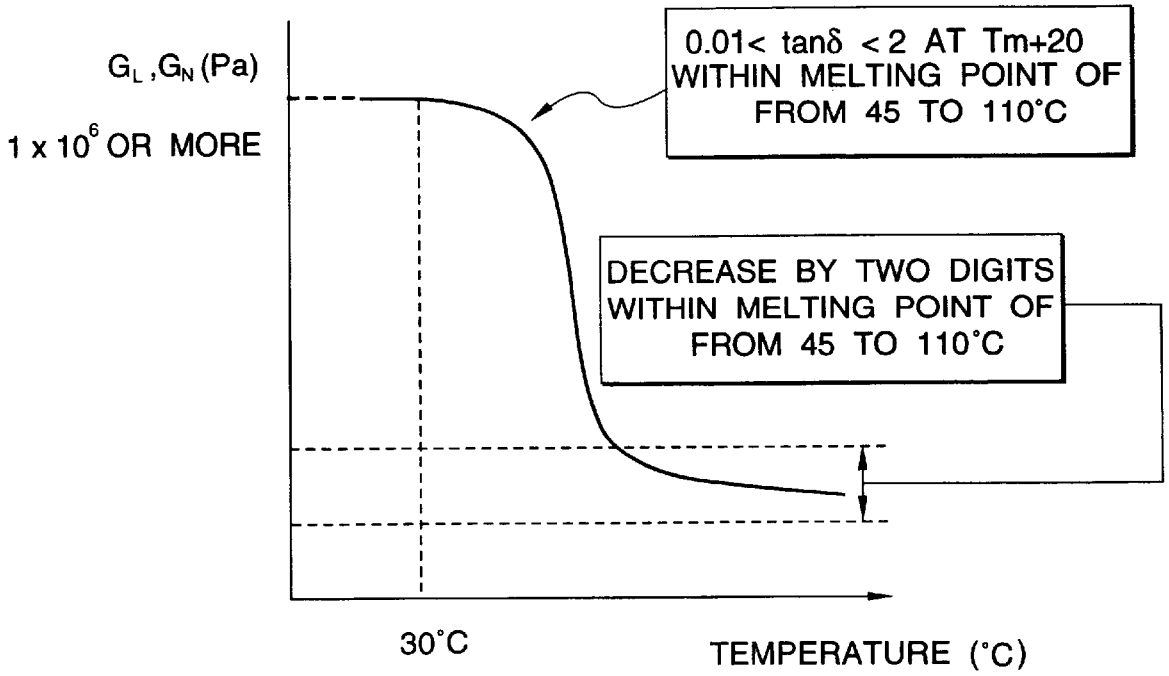
FIG. 1 is a graph showing preferred characteristics of the electrophotographic toner in the invention, in which the ordinate indicates common logarithm of storage modulus $\log G_L$ or common logarithm of loss modulus $\log G_N$, and the abscissa indicates the temperature.

The electrophotographic developer of the invention contains at least a toner for developing an electrostatic image containing a coloring agent and a binder resin containing, as a main component, a crystalline resin having a melting point of about from 60 to 120° C., and a carrier having a resin film containing at least a nitrogen-containing resin on a surface thereof. The electrophotographic developer of the invention will be described separately for the toner for developing an electrostatic image and the carrier, which are the essential components thereof, and thereafter the evaluation of the charging property of the electrophotographic developer of the invention will be made.

Electrophotographic Toner

The electrophotographic toner (hereinafter sometimes simply referred to as a "toner") of the invention contains a binder resin and a coloring agent, and may further contain other components depending on necessity.

Binder Resin

The main component of the binder resin of the toner used in the invention is necessarily a crystalline resin. A polymerizable monomer and a resin constituting the binder resin in the invention are not particularly limited as far as they can constitute a resin having crystallinity.

In the case where the main component of the binder resin of the toner used in the inventions of no crystallinity, i.e., is amorphous, it is impossible to ensure toner blocking resistance, i.e., image storage stability, with maintaining the good low temperature fixing property.

The term "crystalline resin" used in the invention means a resin that has a clear endothermic peak, rather than stepwise change of endothermic amount, upon measurement with a differential scanning calorimeter (DSC). In the case of a copolymer obtained by copolymerizing other components on the main chain of the crystalline resin, the copolymer is also designated as the crystalline resin when the amount of the other components is 50% by weight or less.

As described in the foregoing, the binder resin of the toner used in the invention contains the crystalline resin as a main component. The term "main component" herein means a primary component among the components constituting the binder resin, and specifically means a component constituting 50% by weight or more of the binder resin. In the invention, the amount of the crystalline resin in the binder resin is preferably 70% by weight or more, and more preferably 90% by weight or more, and it is particularly preferred that the entire binder resin is the crystalline resin.

Specific examples of the crystalline resin include a polyester resin using a dicarboxylic acid of a long-chain alkyl, such as adipic acid, pimelic acid, suberic acid, azelaic acid, sebacic acid, dodecanoic diacid and tridecanoic diacid, and a diol of a long-chain alkyl or alkenyl, such as butanediol, pentanediol, hexanediol, heptanediol, octanediol, nonanediol, decanediol and batyl alcohol; and a vinyl series resin using a (meth)acrylate of a long-chain alkyl or alkenyl, such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth) acrylate, stearyl (meth)acrylate, oleyl (meth)acrylate and behenyl (meth)acrylate, and crystalline resins of the polyester resin series are preferred from the standpoint of adhesion property upon fixing on paper, charging property and adjustment of melting point within a preferred range. An aliphatic series crystalline polyester resin having an appropriate melting point is preferred.

The crystalline polyester resin is synthesized from an acid (dicarboxylic acid) component and an alcohol (diol) component. In the following description, a constitutional part that has been the acid component before synthesizing the polyester resin is referred to as an "acid-derived constitutional component", and a constitutional part that has been the alcohol component before synthesizing the polyester resin is referred to as an "alcohol-derived constitutional components".

Acid-derived Constitutional Component

Examples of the acid becoming the acid-derived constitutional component include various decarboxylic acids. Among these, an aromatic dicarboxylic acid and an aliphatic dicarboxylic acid are preferred, and an aliphatic dicarboxylic acid is more preferred, with a linear carboxylic acid being particularly preferred.

Examples of the aliphatic dicarboxylic acid include oxalic acid, malonic acid, succinic acid, glutaric acid, adipic acid, pimeic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, as well as a lower alkyl ester and an anhydride thereof, but it is not limited to these examples.

Examples of the aromatic dicarboxylic acid include terephthalic acid, isophthalic acid, 2,6-naphthalenedicarblxylic acid and 4,4'-biphenyldicarboxylic acid, and among these, terephthalic acid is preferred from the standpoint of availability and easy formation of a polymer having a low melting point.

The acid-derived constitutional component preferably contain, in addition to the aliphatic dicarboxylic acid-derived constitutional component and the aromatic dicarboxylic acid-derived constitutional component, such constitutional components as a dicarboxylic acid-derived constitutional component having a double bond and a dicarboxylic acid-derived constitutional component having a sulfonic acid group.

The dicarboxylic acid-derived constitutional component having a double bond includes a constitutional component derived from a dicarboxylic acid having a double bond and also a constitutional component derived from a lower alkyl ester or an acid anhydride of a dicarboxylic acid having a double bond. The dicarboxylic acid-derived constitutional component having a sulfonic acid group includes a constitutional component derived from a dicarboxylic acid having a sulfonic acid group and also a constitutional component derived from a lower alkyl ester or an acid anhydride of a dicarboxylic acid having a sulfonic acid group.

The dicarboxylic acid having a double bond is preferably used because the whole of the resin can be crosslinked by utilizing the double bond to prevent offset upon fixing. Examples of such a dicarboxylic acid include fumaric acid, maleic acid, 3-hexenedioic acid and 3-octenedioic acid, and it is not limited to these examples. A lower alkyl ester and an acid anhydride thereof are also exemplified. Among these acids, fumaric acid and maleic acid are preferred from the standpoint of cost.

The dicarboxylic acid having a sulfonic acid group is effective since a coloring material, such as a pigment, can be suitably dispersed. When a sulfonic acid group is present upon emulsifying or suspending the whole of the resin in water to produce fine particles, emulsification or suspension can be effected without a surface active agent used as described later. Examples of the dicaroxylic acid having a sulfonic acid group include sodium 2-sulfoterephthalate, sodium 5-sulfoisophthalate and sodium sulfosuccinate, and it is not limited to these examples. A lower alkyl ester and an acid anhydride thereof are also exemplified. Amount these acids, sodium 5-sulfoisophthalate is preferred from the standpoint of cost.

The acid-derived constitutional component other than the aliphatic dicarboxylic acid-derived constitutional component and the aromatic dicarboxylic acid-derived constitutional component preferably contained in a content of from 1 to 20% by constitution, and more preferably from 2 to 10% by constitution, in the total acid-derived constitutional component.

When the contact is less than 1% by constitution, there are some cases where the pigment is insufficiently dispersed, and the emulsion particle diameter is increased, whereby adjustment of the toner particle diameter by aggregation becomes difficult. When it exceeds 20% by constitution, there are some cases where the crystallinity of the polyester resin is lowered to decrease the melting point, whereby the storage stability of the images is deteriorated, and the emulsion particle diameter becomes too small to fail to form a latex.

The term "% by constitution" used herein means a percentage where the respective constitutional components in the polyester resin (i.e., the acid-derived constitutional component and the alcohol-derived constitutional component) each is designated as one unit (mole).

Alcohol-derived Constitutional Component

An alcohol for forming the alcohol-derived constitutional component is preferably an aliphatic diol. Specific examples thereof include ethylene glycol, 1,3-propanediol, 1,4-butanediol, 1,5-pentanediol, 1,6-hexanediol, 1,7-hepatanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol, and it is not limited to these examples.

The alcohol-derived constitutional component preferably has a content of the aliphatic diol-derived constitutional component of 80% by constitution or more and contains other components depending on necessity. The alcohol-derived constitutional component more preferably has a content of the aliphatic diol-derived constitutional component of 90% by constitution or more.

When the content of the aliphatic diol-derived constitutional component is less than 80% by constitution, there are some cases where the crystallinity of the polyester resin is lowered to decrease the melting point, whereby the toner blocking resistance, the storage stability of images and the low temperature fixing property are deteriorated.

Examples of the other components contained depending on necessity include such constitutional components as a diol-derived constitutional component having a double bond and a diol-derived constitutional component having a sulfonic acid group.

Examples of the diol having a double bond include 2-butene-1,4-diol, 3-butene-1,6-diol and 4-butene-1,8-diol.

Examples of the diol having a sulfonic acid group include sodium benzene-1,4-dihydroxy-2-sulfonate, sodium benzene-1,3-dihydroxymethyl-5-sulfonate and sodium 2-sulfo-1,4-butanediol.

In the case where the alcohol-derived constitutional component other than the aliphatic diol-derived constitutional component (i.e., the diol-derived constitutional component having a double bond and the diol-derived constitutional component having a sulfonic acid group) is added, the content of these alcohol-derived constitutional component is preferably from 1 to 20% by constitution, and more preferably from 2 to 10% by constitution.

When the content of the alcohol-derived constitutional component other than the aliphatic diol-derived constitutional component is less than 1% by constitution, there are some cases where the pigment is insufficiently dispersed, and the emulsion particle diameter is increased, whereby adjustment of the toner particle diameter by aggregation becomes difficult. When it exceeds 20% by constitution, there are some cases where the crystallinity of the polyester resin is lowered to decrease the melting point, whereby the storage stability of the images is deteriorated, and the emulsion particle diameter becomes too small to fail to form a latex.

The binder resin in the toner used in the invention has a melting point about from 60° C. to 120° C., and preferably from 60° C. to 100° C.

When the melting point is lower than 60° C., problems occur in the storage stability of the toner and the storage stability of the image after fixing. When it exceeds 120° C., the low temperature fixing cannot be sufficiently effected in comparison to the conventional toners.

The measurement of the melting point of the crystalline resin in the invention is obtained in the following manner. A measurement is carried out by using a differential scanning calorimeter (DSC) from room temperature to 150° C. at a temperature increasing rate of 10° C. per minute, and the melting point is obtained as a melting peak of the input compensation differential scanning calorimeter measurement shown by JIS K7121. While some kinds of crystalline resins may exhibit plural melting peaks, the maximum peak is designated as the melting point in the invention.

The process for producing the polyester resin is not particularly limited, and it can be produced by the general polyester polymerization process where an acid component and an alcohol component are reacted. For example, such processes as the direct polymerization process and the ester exchanging process are selected depending on the species of the monomers. The molar ratio of the acid component and the alcohol component upon reaction (acid component/alcohol component) cannot be unconditionally determined since the reaction conditions vary, and is generally about 1/1.

The production of the polyester resin can be carried out at a polymerization temperature of from 180° C. to 230° C., and the reaction system is subjected to reduced pressure depending on necessity, whereby the reaction is carried out while water and alcohols formed upon condensation are removed.

In the case where monomers are not dissolved in or not compatible to each other at the reaction temperature, a solvent having a high boiling point may be added as a dissolution assistant to effect dissolution. The polycondensation reaction is carried out while the dissolution assistant is distilled off. In the case where a monomer having poor compatibility is present in the copolymerization reaction, it is effective that the monomer having poor compatibility is previously condensed with an acid or an alcohol that is to be polycondensed with the monomer, followed by subjecting to polycondensation with the main components.

Examples of a catalyst that can be used upon production of the polyester resin include a compound of an alkali metal, such as sodium and lithium, a compound of an alkaline earth metal, such as magnesium and potassium, a compound of a metal, such a zinc, manganese, antimony, titanium, tin, zirconium and germanium, a phosphours compound, a phosphoric compound and an amine compound.

Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropxide, titanium tetrabutoxide, anitomny trioxide, triphenylanitomny, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenylphosphite, tris(2,4-butylphenyl)phosphite, ethyltriphenylphosphonium bromide, triethylamine and triphenylamine.

Coloring Agent

The coloring agent in the toner used in the invention is not particularly limited and may be either a dye or a pigment, and a pigment is preferred from the standpoint of light resistance and water resistance. Preferred examples of the pigment include known pigments, such as Carbon Black, Aniline Black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, Quinacridone, Benzidine Yellow, C.I. Pigment Red 48:1, C.I. Pigment Red 57:1, Pigment Red 122, C.I. Pigment Red 185, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1 and C.I. Pigment Blue 15:3.

Magnetic powder can also be used as the coloring agent. Examples of the magnetic powder include known magnetic materials, such as a ferromagnetic metal such as cobalt, iron and nickel, and alloy and an oxide of a metal, such as cobalt, iron, nickel, aluminum, lead, magnesium, zinc and manganese.

The coloring agent may be used singly or in combination of two of more of them. The content of the coloring agent in the electrophotographic toner of the invention is preferably from 0.1 to 40 parts by weight, and more preferably from 1 to 30 parts by weight, per 100 parts by weight of the total raw material amount of the toner.

Toners of respective colors, i.e., a yellow toner, a magenta toner, a cyan toner and a black toner, can be obtained by appropriately selecting the species of the coloring agents.

Other Components

The other components that can be used in the toner used in the invention are not particularly limited and can be appropriately selected depending on purpose, and examples thereof include various kinds of know additives, such as inorganic fine particle, organic fine particles, a charge controlling agent and a releasing agent.

As the inorganic fine particles, known inorganic particles may be used singly or in combination of two or more kinds of them, and examples thereof include silica fine particles, titanium oxide fine particles, alumina fine particles, cerium oxide fine particles and particles obtained by subjecting the surface of the these particles to a hydrophobic treatment. Silica fine particles having a smaller refractive index than the binder resin are preferred because the coloring property and the transparency, such as the OHP transmission property, are not impaired. The silica fine particles may be subjected to a surface treatment, and for example, those subjected to a surface treatment with a silane series coupling agent, a titanium series coupling agent or a silicone oil are preferred.

When these inorganic fine particles are added, the viscoelasticity of the toner can be adjusted, and the offset resistance and the releasing property can be improved. The inorganic fine particles are preferably added in an amount of from 0.2 to 40% by weight, and more preferably from 0.5 to 20% by weight, based on the total amount of the toner.

The organic fine particles are generally used for improving the cleaning property and the transfer property. Examples of the organic fine particles include fine particles of polystyrene, polymethyl methacrylate and polyvinylidene fluoride.

The charge controlling agent is generally used for improving the charging property. Examples of the charge controlling agent include a metallic azo compound, such as a chromium series azo dye, an iron series azo dye and an aluminum azo dye, a metallic complex of salicylic acid, nigrosine and a quaternary ammonium salt.

The releasing agent is generally used for improving the releasing property. Examples of the releasing agent include a low molecular weight polyolefin, such as polyethylene, polypropylene and polybutene; a silicone having a softening point upon heating; an aliphatic acid amide, such as oleic amide, erucic amide, recinoleic amide and stearic amide; vegetable wax, such as carnauba wax, rice wax, candelilla wax, wood wax and jojoba oil; animal wax, such as yellow beeswax; mineral or petroleum wax, such as montan wax, ozokerite, ceresin, paraffin wax, microcrystalline wax and Fischer-Tropsch wax; and ester series wax, such as a fatty acid ester, a montanic acid ester and a carboxylic acid ester. In the invention, the releasing agent may be used singly or in combination of two or more of them.

The content of the releasing agent is preferably from 1 to 20 parts by weight, and more preferably from 2 to 15 parts by weight, per 100 parts by weight of the total amount of the raw material of the toner. When the amount is less than 1 part by weight, no effect is obtained by the addition. When it exceeds 20 parts by weight, adverse affect to the charging property is liable to occur, and since the toner is liable to be broken inside the developing device, the releasing agent and the toner resin are spent to the carrier to lower the charge. Moreover, when a color toner is used, for example, oozing on the image surfaces is liable to be insufficient to make the releasing agent remain in the image, and therefore it is insufficient since the transparency is deteriorated. The melting point of the releasing agent is preferably from 50° C. to 120° C., and more preferably from 60° C. to 100° C. When the melting point of the releasing agent is lower than 60° C., the changing temperature of the releasing agent is too low, whereby the blocking resistance is deteriorated, and the developing property is deteriorated when the temperature inside the duplicator is increased. When it exceeds 120° C., the changing temperature of the releasing agent is too high to impair the low temperature fixing property of the crystalline resin.

The volume average particle diameter of the electrophotographic toner used in the invention is preferably from 1 $\mu$m to 12 $\mu$m, more preferably from 2 $\mu$m to 8 $\mu$m, and further preferably from 3 $\mu$m to 6 $\mu$m. The number average particle diameter thereof is preferably from 1 $\mu$m to 20 $\mu$m, and more preferably from 2 $\mu$m to 8 $\mu$m. The value (volume average particle diameter/number average particle diameter), as an index of particle size distribution, is preferably 1.6 or less, and more preferably 1.5 or less. When the value is more than 1.6, the expanse of the particle size distribution becomes large to broaden the distribution of the charge amount, whereby a toner of the inverse polarity and a lowly charged toner are liable to occur.

The volume average particle diameter and the number average particle diameter can be obtained, for example, by measuring with a Coulter Counter (produced by Beckman Coulter, Inc.) using an aperture diameter of 50 $\mu$m. The measurement is carried out after the toner is dispersed in an electrolyte aqueous solution (Isoton solution), followed by subjecting ultrasonic wave dispersion for 30 seconds or more.

Preferred Physical Property of Electrophotographic Toner used in the Invention

The electrophotographic toner used in the invention is demanded to have sufficient hardness at ordinary temperature. Specifically, the dynamic viscoelasticity thereof at an angular frequency of 1 rad/sec and 30° C. is preferably a storage modulus $G_L(30)$ of $1\times10^6$ Pa or more and a loss modulus $G_N(30)$ of $1\times10^6$ Pa or more. The storage modulus $G_L$ and the loss moulus $G_N$ are defined in detail in JIS K6900.

When the storage modulus $G_L(30)$ is less than $1\times10^6$ Pa or the loss modulus $G_N(30)$ is less than $1\times10^6$ Pa at an angular frequency of 1 rad/sec and 30° C., there are some case where the toner particles are deformed due to the pressure and the shearing force applied from the carrier upon mixing with the carrier in the developing device, so as to fail to maintain the stable charge developing characteristics. Furthermore, there are some cases where they are deformed by the shearing force applied by a cleaning blade upon cleaning the toner on a latent image bearing member (photoreceptor), so as to cause cleaning failure.

In the case where the storage modulus $G_L(30)$ and the loss modulus $G_N(30)$ are in the ranges specified in the foregoing, it is preferred since the characteristics upon fixing is stabilized even when it is used in a high speed electrophotograhic apparatus.

Furthermore, the electrophotographic toner used in the invention preferably has a temperature range, within which the changes of the storage modulus $G_L$ and the loss modulus $G_N$ caused by temperature change are two or more digits within a temperature range of 10° C. (i.e., the values of $G_L$ and $G_N$ are decreased to 1/100 or less by increasing the temperature by 10° C.).

When the storage modulus $G_L$ and the loss modulus $G_N$ do not have such a temperature range, the fixing temperature is increased, and as a result, there are some cases where it is insufficient to effect fixing at a low temperature to reduce the energy consumption in the fixing step.

FIG. 1 is a graph showing preferred characteristics of the electrophotographic toner used in the invention. In FIG. 1, the ordinate indicates common logarithm of storage modulus $\log G_L$ or common logarithm of loss modulus $\log G_N$, and the abscissa indicates the temperature. An electrophotographic toner having such charateristics exhibits sudden decrease of the modulus at the melting point in the temperature range of from 60° C. to 120° C., and the modulus thereof is stabilized in the prescribed range. Therefore, even when it suffers a high temperature upon fixing, the viscosity thereof is not excessively decreased, so as to prevent excessive penetration into the transfer material, such as paper, and formation of offset.

The process for producing the electrophotographic toner used in the invention as described in the foregoing is not particularly limited, and the process for producing the electrophotographic toner used in the invention described later is preferred. Because the electrophotographic toner used in the invention has the constitution described in the foregoing, it is excellent in the toner blocking resistance, the storage stability of an image and the low temperature fixing property. Furthermore, in the case where the polyester resin has a crosslinked structure owing to unsaturated bonds, an electrophotographic toner having a wide fixing latitude with good offset resistance and resistance to penetration of the toner into the recording medium, such as paper, can be particularly obtained. Moreover, when the shape of the toner is sphere, the transfer property, such as the transfer efficiency, can be improved.

Production Process of Electrophotographic Toner

The process for producing the electrophotographic toner used in the invention is not particularly limited, and a wed granulation process is preferred. Examples of the wet granulation process include known processes, such as a melt suspension process, an emulsion aggregation process and a dissolution suspension process. The emulsion aggregation process as one example will be described below.

The emulsion aggregation process has an emulsifying step of emulsifying the crystalline resin, such as the crystalline polyester resin, which has been described in the section of "Binder Resin" in the chapter of "Electrophotographic Toner" of the invention, to form emulsion particles (liquid droplets), an aggregating step of forming aggregates of the emulsion particles (liquid droplets), and a fusing step of head fusing the aggregates. In the following, the case using the crystalline polyester resin as the crystalline resin will be described as one example.

Emulsifying Step

In the emulsifying step, the emulsion particles (liquid droplets) of the polyester resin is formed by applying a shearing force to a solution obtained by mixing an aqueous medium and a mixed liquid (polymer liquid) containing a sulfonated polyester resin and, depending on necessity, a coloring agent.

Upon application of a shearing force, the viscosity of the polymer liquid is decreased by dissolving the polyester resin in an organic solvent, so as to form the emulsion particles. In order to stabilize the emulsion particles and to increase the viscosity of the aqueous medium, a dispersant may also be used. Hereinafter, the dispersion of the emulsion particles is sometimes referred to as a "resin particle dispersion".

Examples of the dispersant include a water soluble polymer, such as polyvinyl alcohol, methyl cellulose, ethyl cellulose, hydroxyethyl cellulose, carboxymethyl cellulose, sodium polyacrylate and sodium polymethacrylate; a surface active agent, such as an anionic surface active agent, e.g., sodium dodecylbenzenesulfonate, sodium octadecylsulfate, sodium oleate, sodium laurate and potassium stearate, a cationic surface active agent, e.g., laurylamine acetate, stearylamine acetate and lauryltrimethylammonium chloride, an amphoteric surface active agent, e.g., lauryldimethylamine oxide, and a nonionic surface active agent, e.g., polyoxyethylene alkyl ether, polyoxyethylenealkyl phenyl ether and polyoxyethylenealkyl amine; and an inorganic compound, such as calcium triphosphate, aluminum hydroxide, calcium sulfate, calcium carbonate and barium carbonate.

In the case where the inorganic compounds are used as the dispersant, while commercially available ones may be used as they are, such a process can be employed to obtain fine particles that fine particles of the inorganic compound are formed in a dispersing medium.

The amount of the dispersant used in preferably from 0.01 to 20 parts by weight per 100 parts by weight of the polyester resin (binder resin).

In the emulsifying step, in the case where a dicarboxylic acid having a sulfonic acid group is copolymerized with the polyester resin (i.e., the acid-derived constitutional component contains an appropriate amount of the dicarboxylic acid-derived constitutional component having a sulfonic acid group), the amount of the dispersion stabilizer, such as a surface active agent, can be reduced, or in alternative, the emulsion particles can be produced without the use thereof.

Examples of the organic solvent include ethyl acetate and toluene, which can be appropriately selected depending on the polyester resin.

The amount of the organic solvent used is preferably from 50 to 5,000 parts by weight, and more preferably from 120 to 1,000 parts by weight, per 100 parts by total amount of the polyester resin and the other monomer used depending on necessity (hereinafter sometimes simply referred to as a "polymer" in total). A coloring agent can be mixed before forming the emulsion particles. As a method for mixing the coloring agent into the resin, melt dispersion by using a disperser can be exemplified. Examples of the coloring agent used include those described for the section of "Coloring Agent" for the electrophotographic toner used in the invention.

Examples of an emulsifier used upon forming the emulsion particles include a homogenizer, a homomixer, a pressure kneader-coater, an extruder and a media disperser. The size of the emulsion particles (liquid droplets) of the polyester resin in terms of an average particle diameter (volume average particle diameter) is preferably from 0.01 $\mu$m to 1 $\mu$m, more preferably from 0.03 $\mu$m to 0.4 $\mu$m and further preferably from 0.03 $\mu$m to 0.3 $\mu$m.

Dispersing the coloring agent can be effected by an arbitrary method, such as dispersion method generally employed using a rotational shearing type homogenizer, as well as a ball mill, a sand mill and a Dyeno mill using media, without any limitation.

It is possible depending on necessity that an aqueous dispersion of the coloring agent is prepared by using a surface active agent, an organic solvent dispersion of the coloring agent is prepared by using a dispersant. Hereinafter, the dispersion of the coloring agent is sometimes referred to as a "coloring agent dispersion". As the surface active agent and the dispersant for dispersing, ones similar to those used for dispersing the polyester resin may be used.

The amount of the coloring agent added is preferably from 1% to 20% by weight, more preferably from 1% to 12% by weight, and further preferably from 2% to 10% by weight, based on the total amount of the polymer.

In the case where the coloring agent is mixed in the emulsifying step, mixing of the polymer and the coloring agent can be effected by mixing the coloring agent or an organic solvent dispersion of the coloring agent with the organic solvent solution of the polymer.

Aggregating Step

In the aggregating step, the resulting emulsion particles are heated to a temperature near the melting point of the polyester resin but lower than the melting point, so as to aggregate them to form aggregates.

Formation of the aggregates of the emulsion particles is effected by making the pH of the emulsion liquid be acidic under stirring. The pH is preferably from 1 to 6, and more preferably from 1.5 to 5. It is also effective to use an aggregating agent at this time.

As the aggregating agent used, a surface active agent having a polarity contrary to the polarity of the surface active agent used in the dispersant, and an inorganic metallic salt, as well as a metallic complex of two or more valences. Particularly, in the case where the metallic complex is used, it is preferred since the amount of the surface active agent used can be reduced to improve the charge characteristics.

Examples of the inorganic metallic salt include a metallic salt, such as calcium chloride, calcium nitrate, barium chloride, magnesium chloride, zinc chloride, aluminum chloride and aluminum sulfate, and an inorganic metallic salt polymer, such as polyaluminum chloride, polyaluminum hydroxide and calcium polysulfide. Among these, an aluminum salt and a polymer thereof are preferred. In order to obtain a sharp particle size distribution, the more preferred, the larger the valence number of the inorganic metallic salt is. Furthermore, a polymer type inorganic metallic salt is more preferred where the valence number is the same.

Fusing Step

In the fusing step, under the stirring similar to the aggregating step, the pH of the suspension of the aggregates is made within the range of from 3 to 7 to terminate the progress of aggregation, and the aggregates are fused by heating to a temperature above the melting point of the polyester resin.

The heating temperature may be any temperature above the melting point of the polyester resin without any problem.

Such a period of heating is sufficient that the fusion can be adequately effected, and it may be about from 0.5 to 10 hours.

The fused particles obtained by fusing can be used as toner particles through a washing step and a drying step depending on necessity. In this case, in order to ensure the charge characteristics and the reliability that are sufficient as a toner, it is preferred that washing is sufficiently effected in the washing step.

In the drying step, ordinary methods can be arbitrarily employed, such as a vibration type fluidized drying method, a spray drying method, a freeze drying method and flash jet method. The toner particles are preferably adjusted to have a water content after drying of 1.0% or less, and more preferably 0.5% or less.

In the fusing step, a crosslinking reaction may be effected during heating the polyester resin to a temperature higher than the melting point or after completing the fusion. The crosslinking reaction may also be effected simultaneously with the aggregation. In the case where the crosslinking reaction is effected, for example, an unsaturated sulfonated crystalline polyester resin formed by copolymerizing a double bond component is used as the binder resin, and the resin is subjected to a radical reaction to introduce the crosslinked structure. At this time, a polymerization initiator is used.

Examples of the polymerization initiator include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-asobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl-4,4-bis (t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butylperoxy isophthalte, 2,2-bis(4,4-di-t-butylperoxycyclohexyl)propane, di-t-butylperoxy-α-methyl succinate, di-t-butylperoxydimethyl glutarate, di-t-butylperoxy hexahydroterephthalate, di-t-butylperoxy azelate, 2,5-dimethyl-2,5-di(t-butylperoxy)hexane, diethylene glycol bis(t-butylperoxycarbonate), di-t-butylperoxytrimethyl adipate, tris(t-butylperoxy)triazine, vinyl tris(t-butylperoxy)silane, 2,2'-azobis(2-methylpropionic amine dihydride chloride), 2,2'-azobis(N-(2-carboxyethyl)-2-methylpropionic amine) and 4,4'-azobis (4-cyanovaleric acid).

These polymerization initiators may be used singly or in combination of two or more of them. The amount and the kind of the polymerization initiator are appropriately selected depending on the amount of the unsaturated part in the polymer, and the kind and the amount of the coloring agent coexisting.

The polymerization initiator may be previously mixed with the polymer before the emulsifying step, or in alternative, may be incorporated into the aggregated bodies in the aggregating step. Furthermore, it may be introduced during the fusing step or after the fusing step. In the case where it is introduced in the aggregating step or the fusing step or after the fusing step, a liquid obtained by dissolving or emulsifying the polymerization initiator in an organic solvent is added to the particle dispersion (such as the resin particle dispersion). The polymerization initiator may contain a known additive, such as a crosslinking agent, a chain transfer agent and a polymerization inhibitor, for the purpose of controlling the polymerization degree.

The particle shape of the toner can be controlled according to the process for producing the electrophotographic toner described in the foregoing. The particle shape of the toner is preferably spherical. By using the spherical shape, the transfer efficiency can be improved by reduction of the non-electrostatic adhesion force, and the powder flowability is also improved.

The toner used in the invention may be added with an external additive, such as a fluidizing agent and a fluidizing aid, on the surface of the toner. Examples of the external additive include known fine particles, such as inorganic fine particles, e.g., silica fine powder having a surface having been subjected to a hydrophobic treatment, titanium oxide fine particles, alumina fine particles, cerium oxide fine particles and carbon black, and polymer fine particles, e.g., polycarbonate, polymethyl methacrylate and a silicone resin, and it is preferred that at least two kinds of external additives are used, and at least one of the external additives has an average primary particle diameter of from 30 nm to 200 nm, and more preferably from 30 nm to 150 nm.

By decreasing the diameter of the toner, the non-electrostatic adhesion force of the photoreceptor (latent image bearing member) is increased, and thus dropouts of the image called transfer failure and hollow characters occur to cause transfer unevenness of an accumulated image. Therefore, it is effective to add an external additive having a large diameter, i.e., an average primary diameter of from 30 nm to 200 nm, so as to improve the transfer property. When the average primary diameter is less than 30 nm, although the flowability of the toner is good in the initial stage, the non-electrostatic adhesion force between the toner and the photoreceptor cannot be sufficiently decreased to lower the transfer efficiency, whereby dropouts of the image and deterioration in uniformity of the image occur. Furthermore, the external additive is buried on the surface of the toner due to the stress caused inside the developing device with the lapse of time, and thus the charging property is changed to cause such problems of decrease in copy density and formation of fogging on the background. When the average primary particle diameter exceeds 200 nm, they are liable to be released from the surface of the toner, and also bring about deterioration of the flowability.

Carrier

As a carrier that can be used in the developer of the invention, it is the essential requirement that the carrier has a resin film containing at least a nitrogen-containing resin on the surface thereof.

Examples of the nitrogen-containing resin include an acrylic series resin containing, for example, dimethylaminoethyl methacrylate, dimethylacrylamide and acrylonitrile, an amino resin containing, for example, urea, urethane, melamine, guanamine and aniline, an amide resin and a urethane resin. Copolymer resins of these resins may also be used.

As the resin for constituting the resin film of the carrier, two or more kinds of resins may be selected from the foregoing nitrogen-containing resins and used in combination. A combination of the nitrogen-containing resin and a resin containing no nitrogen may also be used. Furthermore, the nitrogen-containing resin may be used in such a manner that the resin is formed into fine particles and dispersed in a resin containing no nitrogen.

Generally, in the case where the crystalline resin, particularly the crystalline polyester resin, is used as the binder resin of the toner, the charge amount is smaller than the conventional resins, and fogging or cloud and maintenance of charge are liable to be insufficient although the low temperature fixing property is excellent. Therefore, the charge amount can be increased, and the charge maintenance property can also be improved by using the carrier coated with the resin containing the nitrogen-containing resin, which is of high negative charging property. In other words, increase of the charging property is compensated by the nitrogen-containing resin, and at the same time, carrier impaction is prevented by the crystalline resin, whereby the charge amount can be increased, and charging stability for a long period of time can be obtained by combining both the resins. In particular, because a urea resin, a urethane resin, a melamine resin and an amide resin have high negative charging property and have high hardness of the resins, these resins are preferably used as the resin for constituting the resin film of the carrier to suppress the reduction in charge amount due to drop off of the resin film.

Examples of the urea resin constituting the resin film of the carrier include the following.

Examples of a bifunctional isocyanate compound include substantially all polymers having an NCO group, including a polymer derived from an isocyanate, such as phenylisocyanate and tolylisocyanate, a polymer derived from a diisocyanate, such as phenylene diisocyanate, xylylene diisocyanate, isoprene diisocyanate, tolylene diisocyanate, diphenylmethane diisocyanate, hexamethylene diisocyanate and cyclohexene diisocyanate, a polymer derived from an adduct formed by previously reacting the diisocyanates with trimethylolpropane or 1,3-butanediol, and a polymer derived from a prepolymer formed by reacting the diisocyanates.

Examples of an isocyanate compound having three or more functionalities include hexamethylene diisocyanate adduct, triphenylmethane triisocyanate, diphenylmethine diisocyanate cycloadduct and 2-isocyanatoethyl-2,6-diisocyanate hexanoate.

In order to improve the contamination resistance by the toner and the external additive, a silicone-modified isocyanate compound may be used. Upon carrying out silicone modification, the modification amount is preferably from 1% to 40%, and more preferably from 3% to 30%.

Examples of the urethane resin constituting the resin film of the carrier include reaction products of a polyol compound, such as an acrylic polyol, a polyester polyol, a urethane polyol, an aliphatic or aromatic polyhydric alcohol, a hydroxyl polyester and a hydroxyl polyalkylene ether, with the foregoing isocyanate compound.

Examples of the amide resin constituting the resin film of the carrier include resins having an amide group on the main chain thereof, and for example, nylon-6, nylon-6,6, nylon-6,10, nylon-11 and nylon-12 can be used. Polyamide resins having hydrogen atoms of a part of all amide bonds having been subjected to alkoxyalkylation are commercially available for enabling solubility in an alcohol, but these are not preferred since the heat resistance, the film strength and the charging characteristics are poor.

The larger the nitrogen content in the resin film of the carrier, the better the negative charging property to the toner is. Therefore, because the crystalline resin, which is poor in charging property, is used in the invention, the nitrogen content on the surface of the carrier is preferably from 0.1% to 50% by atom, more preferably from 0.2% to 45% by atom, and further preferably from 0.5% to 45% by atom, in order to ensure the sufficient negative charging property.

The nitrogen content on the surface of the carrier can be measured by XPS (X-ray photoelectron spectrum analyzer). While XPS is a measuring apparatus for analyzing the surface composition of a depth of about 0.1 $\mu$m, because the charge imparting capability of the carrier is mainly dominated by the composition near the surface, the measurement results of nitrogen contents by XPS can be an index of the actual charging property.

In order to adjust the nitrogen content on the surface of the carrier into the foregoing range, the nitrogen content in the monomer as a raw material is previously adjusted before synthesizing the resin constituting the resin film. Furthermore, for example, in the case of an amide resin and a urethane resin, which are resins having a nitrogen atom in the bonding site, a resin having a large nitrogen content can be synthesized by using a monomer having a small number of atoms (for example, a monomer having a short main chain) as a raw material.

In general, a carrier is demanded to have an appropriate electric resistance, and specifically, an electric resistance of about from $10^9$ to $10^{14}$ Ω·cm is demanded. For example, in the case where the electric resistance is as low as $10^6$ Ω·cm as in an iron powder carrier, such problems occur that the carrier adheres on an image part on the photoreceptor (latent image bearing member) by charge implantation from a developer sleeve (developer bearing member), and the charge of the latent image escapes through the carrier to cause disorder of the latent image and drop off of the image. When an insulating resin is coated to a large thickness, on the other hand, the electric resistance becomes too high to prevent leakage of the carrier charge, and as a result, a problem of an edge effect occurs in that the image density in the central part of a large image area is extremely small although an image of sharp edges can be obtained. Therefore, it is preferred that electroconductive fine powder is dispersed in the resin film for adjusting the resistance of the carrier.

The electroconductivity of the electroconductive fine powder itself is preferably $10^{10}$ Ω·cm or less, and more preferably $10^9$ Ω·cm or less. Specific examples of the electroconductive film powder include a metal, such as gold, silver and copper; carbon black; a semiconductive oxide, such as titanium oxide and zinc oxide; and powder formed, for example, of titanium oxide, zinc oxide, barium sulfate, aluminum borate or potassium titanate, the surface of which is covered, for example, with tin oxide, carbon black or a metal. Among these, carbon black is preferred because it is good in production stability, cost and electroconductivity. The kind of carbon black is not particularly limited, and known ones can be used. Carbon black having a DBP (dibutyl phthalate) oil absorption of from 50 ml to 300 ml per 100 g is particularly preferred. The average particle diameter of carbon black is preferably 0.1 $\mu$m or less, and the primary particle diameter is preferably 50 nm or less for uniform dispersion. Basic carbon black is preferred from the standpoint of charging property.

Examples of the method for forming the resin film on the surface of a carrier core material include a dipping method, in which powder of the carrier core material is dipped in a film forming solution (a solution obtained by mixing or dispersing a resin constituting the resin film and/or materials constituting the resin film, such as resin fine particles and electroconductive fine particles, hereinafter the same), a spraying method, in which the film forming solution is sprayed on the carrier core material, a fluidized bed method, in which the film forming solution is sprayed on the carrier core material in a fluidized state by flowing air, a kneader/coater method, in which the carrier core material and the film forming solution are mixed in a kneader/coater with distilling off the solvent, and a powder coating method, in which the resin constituting the resin film is formed into fine particles, which are mixed with the carrier core material in a kneader/coater at a temperature higher than the melting point of the resin, followed by cooling, so as to form the resin film. In the invention, the kneader/coater method and the powder coating method are preferred.

Examples of the solvent used in the film forming solution used in the kneader/coater method is not particularly limited as long as it dissolves the matrix resin constituting the resin film, and examples thereof include an aromatic hydrocarbon, such as toluene and xylene; a ketone, such as acetone and methyl ethyl ketone; an ether, such as tetrahydrofuran and dioxane; and a mixed solvent thereof.

In the case where the resin fine particles are dispersed in the resin film, it is preferred that the resin fine particles are in a state of fine particles in the film forming solution, and therefore it is preferred that the resin fine particles are substantially not dissolved in the solvent used in the film forming solution (i.e., have solvent insolubility). According thereto, the resin fine particles are not aggregated in the resin film but maintain the form of primary particles.

The average thickness of the resin film of the carrier formed in the foregoing procedures is generally about from 0.1 $\mu$m to 10 $\mu$m, and preferably from 0.2 $\mu$m to 3 $\mu$m. The average thickness (l) of the resin film can be conveniently calculated by the following equation (A), in which $\rho_D$ represents the specific gravity of the carrier core material, D represents the average particle diameter of the carrier core material, $\rho_C$ represents the average specific gravity of the coated resin, and $W_C$ represents the total coated amount of the resin:

$$\text{Average thickness (l)}=(\text{resin amount of film per one carrier/surface area per one carrier})/(\text{average specific gravity of coated resin})=(4/3\pi\cdot(D/2)^3\cdot\rho_D\cdot W_C)/((4\pi(D/2)^3)/\rho_C)=(1/6)\cdot(D\cdot\rho_D\cdot W_C/\rho_C) \quad \text{Equation (A)}$$

The core material used in the carrier used in the invention (carrier core material) is not particularly limited. Examples thereof include a magnetic metal, such as iron, steel, nickel and cobalt, a magnetic oxide, such as ferrite and magnetite, and glass beads, and it is preferably a magnetic material in order to apply the magnetic brush method. The volume average particle diameter of the carrier core material is preferably from 10 $\mu$m to 150 $\mu$m, and more preferably from 20 $\mu$m to 100 $\mu$m.

In the electrophotographic developer of the invention, the mixing ratio (weight ratio) of the electrophotographic toner and the carrier (toner/carrier) is generally about from 1/100 to 30/100, and preferably about from 2/100 to 20/100.

Evaluation of Charge

The measurement of the charge amount of the entire toner is generally effected by using a blow off charge amount measuring apparatus, but the charge distribution of the toner cannot be measured by the apparatus. When the charging property of the toner is measured for an electrophotographic developer formed with a toner and a carrier, the charge distribution of the toner can be conveniently measured by a charge spectrograph method (CSG method) described, for example, in JP-A-57-79958. In the CSG method, a value of p/d is obtained where q represents the charge amount of the respective toner particles and d represents the particle diameter of the toner. Therefore, the charge distribution in the developer can be obtained by the CSG method, and thus the presence or absence of a toner of the inverse polarity and a lowly charged toner, which is substantially not charged, can be measured.

Figure 2:
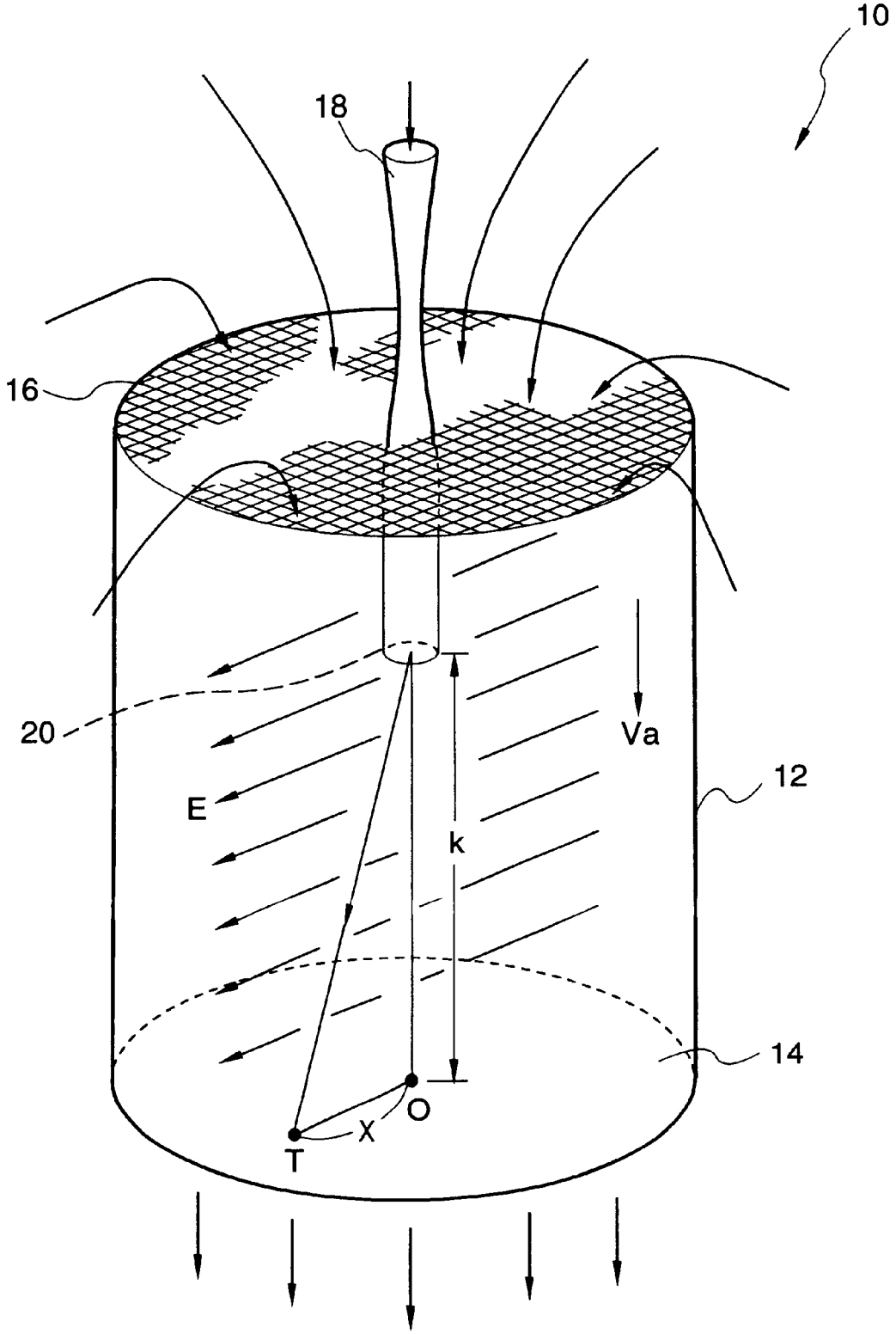
FIG. 2 is a schematic perspective view of a measuring apparatus for measuring the frequency distribution of the q/d value by the CSG method.

FIG. 2 is a schematic perspective view of a measuring apparatus for measuring the frequency distribution of the q/d value by the CSG method. The measuring apparatus 10 has a cylindrical body 12, a filter 14 closing a lower opening thereof, a mesh 16 closing an upper opening thereof, a sample supplying tube 18 protruding from the center of the mesh 16 toward the interior of the body 12, a suction pump (not shown in the figure) sucking air from the lower opening of the body 12, and an electric field generating device applying an electric field E from the side of the body 12.

The suction pump arranged to function in such a manner that air inside the body 12 is uniformly sucked over the whole surface of the filter 14 through the filter 14 on the lower opening of the body. According thereto, air flows into the body 12 through the mesh 16 on the upper opening, and a laminar flow of a constant air flow rate Va is formed in the vertical downward direction inside the body 12. Furthermore, a constant and uniform electric field E is applied in the direction perpendicular to the air flow by an electric field generator.

The toner particles are gradually thrown down (dropped) into the interior of the body 12 in the foregoing state through the sample supplying tube 18. The toner particles come out from an sample outlet 20 at the tip end of the sample supplying tube 18 flies, if no influence is received from the electric field E, in the vertical down ward direction with receiving the influence of the air laminar flow to reach the center O of the filter 14. (At this time, the distance k between the sample outlet 20 and the filter 14 is a straight flight distance of the toner.) The filter 14 is formed with a coarse polymer filter and sufficiently passes air but does not pass the toner particles, which remain on the filter 14. However, in the case where the toner has charge, the toner particles receive influence of the electric field E to reach a point (point T in FIG. 2) on the filter 14, which is deviated from the center O in the propagation direction of the electric filed E.

The distance (displacement)×between the point T and the center O is measured, and the frequency distribution thereof is obtained, whereby the frequency distribution of the q/d value can be obtained. (Actually, in the invention, the bottom value is directly obtained by image analysis.)

More specifically, the relationship between the displacement×(mm) with the charge amount q (fC) of the toner and the particle diameter d ($\mu$m) of the toner is shown by the following equation (B):

$$q/d=(3\pi\eta Va/kE)\cdot x \quad \text{(B)}$$

In the equation (B), $\eta$ represents the viscosity of air (kg/m·sec), Va represents the flow rate of air (m/sec), k represents the straight flight distance of the toner (m), and E represents the electric field (V/m).

In the invention, the conditions of the measurement apparatus 10 shown in FIG. 2 are set in such a manner that the conditions in the equation (B) are the following values.

Viscosity of air $\eta$: $1.8\times10^{-5}$ (kg/m·sec)

Flow rate of air Va: 1 (m/sec)

Straight flight distance of toner k: 10 (cm)

Electric field E: 190 (V/cm)

Substitution of these values in the equation (B) provides the following:

$$q(fC)/d(\mu m)=0.09\cdot x$$

Thus, the frequency distribution of the q/d value can be obtained. While the frequency distribution of the q/d value in the invention can also be measured by other methods than the CSG method, a convenient measurement can be effected with fewer errors by the CSG method.

When the q/d value is measure for the respective toner particles, and the frequency distribution thereof is shown as a graph, it exhibits a substantial normal distribution having the upper limit and the lower limit. The q/d value of the lower limit of the graph (the lower limit after reversing positive and negative for the case of a negative charging toner) is designated as a bottom value. Since the toner used in the invention is a negative charge toner, the bottom value of the q/d value becomes a negative numeric.

When the bottom value of the q/d value excessively approaches zero (i.e., a lowly charged toner) or becomes a positive value (i.e., a toner of the inverse polarity), dropouts of the image part and fogging in the non-image part are liable to occur. In the case where the charge amount of the toner is further decreased by allowing the developer to stand in a high temperature and high humidity environment, there are cases where a problem called cloud occurs in that the circumference of the developing device is contaminated by the toner. Therefore, it is demanded that the absolute value of the bottom value in the frequency distribution of the q/d value is maintained above the prescribed value, and specifically, the absolute value of the bottom value is preferably from 0.009 to 18 (i.e., the bottom value is preferably from −18 to −0.009), more preferably from 0.045 to 9 (i.e., the bottom value is more preferably from −9 to −0.045), and further preferably from 0.09 to 9 (i.e., the bottom value is further preferably from −9 to −0.09).

Process for forming Image

The process for forming an image using the electrophotographic developer of the invention will be described below.

The process for forming an image contains a latent image forming step of forming an electrostatic latent image on a surface of a latent image bearing member, a developing step of developing the electrostatic latent image formed on the surface of the latent image bearing member with a developer carried on a developer bearing member to form a toner image; a transferring step of transferring the toner image formed on the latent image bearing member to a surface of a transfer material, such as paper; and a fixing step of heat fixing the toner image transferred to the surface of the transfer material, and the electrophotographic developer of the invention is used as the developer.

As the foregoing steps, steps having been know in the process for forming an image can be utilized.

As the latent image bearing member, for example, an electrophotographic photoreceptor and a dielectric recording material can be used.

In the case of an electrophotographic photoreceptor, the surface of the electrophotographic photoreceptor is uniformly charged with a corotron charging device or a contact charging device and then exposed to form an electrostatic latent image (latent image forming step). A developing roll having a developer layer formed on the surface thereof is made in contact with or close to the electrophotographic photoreceptor to attach the toner particles on the electrostatic latent image, so as to form a toner image on the electrophotographic photoreceptor (developing step). The toner image thus formed is transferred to a transfer material, such as paper, by utilizing, for example, a corotron charging device (transferring step). The toner image thus transferred to the surface of the transfer material is heat fixed by a fixing device to form the final toner image.

Examples of the transfer material (recording material), to which the toner image is transferred, include ordinary paper and an OHP sheet used in a duplicator and a printer of an electrophotographic system. In order to further improve the smoothness of the image surface after fixing, the surface of the transfer material is preferably as smooth as possible, and for example, coated paper formed by coating the surface of ordinary paper with a resin and art paper for printing can be preferably used.

According to the process for forming an image of the invention using the electrophotographic developer of the invention, an image of excellent image quality can be formed since the toner is not aggregated, and the low temperature fixing better than the conventional technique can be carried out, with excellent storage stability of the image thus formed. Furthermore, in the case where the binder resin has a crosslinked structure, substantially no attachment of the releasing agent to the transfer material occurs, and therefore, an image is formed on a transfer material having adhesiveness on the back surface thereof, such as a seal and a tape, whereby seals and stickers having an image of high image quality and high density formed thereon can be produced.

The invention will be described in more detail with reference to the following examples, but the invention is not construed as being limited thereto.

EXAMPLE 1

Synthesis of Crystalline Polyester Resin (1)

17.4 parts by weight of 1,10-decanediol, 2.2 parts by weight of sodium dimethyl 5-sulfoisophthalate, 10 parts by weight of dimethylsulfoxide and 0.03 part by weight of dibutyl tin oxide as a catalyst are placed in a three-neck flask having been dried by heat, and the air inside the flask is replaced with a nitrogen gas by a pressure reduction operation to make an inert atmosphere, followed by stirring by mechanical stirring at 180° C. for 3 hours. Dimethylsulfoxide is distilled off under reduced pressure, and 26.5 parts by weight of dimethyl dodecanedioate is added thereto, followed by stirring at 180° C. for 1 hour.

Thereafter, the temperature is gradually increased to 220° C. under reduced pressure, followed by stirring for 30 minutes. When the content of the flask is in a viscous state, it is then cooled with air to terminate the reaction, so as to synthesize 36 parts by weight of a crystalline polyester resin (1).

The resulting crystalline polyester resin (1) is subjected to a molecular weight measurement by gel permeation chromatography (GPC) (polystyrene standard), and it has a weight average molecular weight (Mw) of 9,200 and a number average molecular weight (Mn) of 6,000.

The crystalline polyester resin (1) is measured for a melting point (Tm) by a differential scanning calorimeter (DSC) in the foregoing measurement method, and it has a clear peak, which has a peak top temperature of 79° C.

The content ratio of the copolymerization component (5-sulfoisophthalic acid component) and the dodecanedioic acid component measured and calculated by an NMR spectrum of the resin is 7.5/92.5.

Production of Electrophotographic Toner (1)

Preparation of Resin Particle Dispersion (1)

150 parts by weight of the resulting crystalline polyester resin (1) is put in 850 parts by weight of distilled water, and the mixture is agitated by a homogenizer (Ultra-Turrax, produced by IKA Japan Co., Ltd.) under heating to 85° C., so as to obtain a resin particle dispersion (1).

Preparation of Coloring Agent Dispersion (1)

250 parts by weight of a phthalocyanine pigment (PV Fast Blue, produced by Dainichiseika Colour and Chemicals Mfg. Co., Ltd.), 20 parts by weight of an anionic surface active agent (Neogen RK, produced by Daiichi Kogyo Seiyaku Co., Ltd.) and 730 parts by weight of ion exchanged water are mixed and dissolved, and the mixture is dispersed by using a homogenizer (Ultra-Turrax, produced by IKA Japan Co., Ltd.), so as to obtain a coloring agent dispersion (1) having a coloring agent (phthalocyanine pigment) dispersed therein.

Preparation of Aggregated Particles 2,400 parts by weight of the resin particle dispersion (1), 100 parts by weight of the coloring agent dispersion (1), 63 parts by weight of a releasing agent particle dispersion, 10 parts by weight of lauroyl peroxide, 5 parts by weight of aluminum sulfate (produced by Wako Pure Chemical Industries, Ltd.) and 100 parts by weight of ion exchanged resin are placed in a stainless steel round flask and adjusted for pH to 2.0, and the mixture is dispersed by using a homogenizer (Ultra-Turrax T50, produced by IKA Japan Co., Ltd.) and then heated to 72° C. over a heating oil bath under stirring. After maintaining at 72° C. for 3 hours, observation with an optical microscope confirms that aggregated particles having an average particle diameter of about 5.0 μm are formed. The stirring and heating is maintained for further 1 hour at 72° C., and then observation with an optical microscope confirms that aggregated particles having an average particle diameter of about 5.5 μm are formed.

Fusing Step

The aggregated particles have pH of 2.4. An aqueous solution obtained by diluting sodium carbonate (produced by Wako Pure Chemical Industries, Ltd.) to 0.5% by weight is gradually added thereto to adjust the pH to 5.0. Thereafter, the temperature is increased to 83° C. under continuous stirring, followed by maintaining for 3 hours.

Thereafter, the reaction product is filtered and sufficiently washed with ion exchanged water, and it is dried by using a vacuum drier, so as to obtain electrophotographic colored particles (1).

The resulting electrophotographic colored particles (1) are measured for an average particle diameter by using a Coulter Counter Type (TA-II) (produced by Beckman Coulter, Inc.), and it is found that the volume average particle diameter is 5.5 μm, and the number average particle diameter is 4.7 μm.

To the resulting electrophotographic colored particles (1), 0.8% by weight of silica fine particles having a primary particle diameter of 40 nm having been subjected to a surface hydrophobic treatment (hydrophobic silica, RX50, produced by Nippon Aerosil Co., Ltd.) and 1.0% by weight of fine particles of a metatitanic acid compound having an average primary particle diameter of 20 nm, which are a reaction product of the treatment of 100 parts by weight of metatitanic acid with 40 parts by weight of isobutyl trimethoxysilane and 10 parts by weight of trifluoropropyl trimethoxysilane, are added and mixed in a Henschel mixer for 5 minutes, so as to produce an electrophotographic toner (1).

Evaluation of Physical Property of Electrophotographic Toner (1)

Measurement of Viscoelasticity

The resulting electrophotographic toner (1) is measured for viscoelasticity by using a rotational plate type rheometer (RDA2, Rhios System ver. 4.3.2, produced by Rheometric Scientific, Inc.).

The measurement is carried out in the following manner. A sample is set in a sample holder, and measurement is carried out at a temperature increasing rate 1° C./min, a frequency of 1 rad/s, a distortion of 20% or less and a detection torque within the measurement certified range. The sample holders of 8 mm and 20 mm are selected depending on necessity.

Changes of the storage modulus G' (Pa) and the loss modulus G" (Pa) are obtained with respect to the temperature change. The temperature (T1), at which the viscoelasticity is quickly changed by two or more digits by glass transition or melting of the polymer), and the temperature (T2), at which the values of viscoelasticity ($G_L$ and $G_N$) are 10,000 Pa·s, are shown in Table 1 below. The values of viscoelasticity ($G_L$ and $G_N$) at 30° C. are shown in Table 2 below.

Measurement and Evaluation of Powder Aggregation Property (Toner Blocking Resistance)

By using Powder Tester (produced by Hosokawa Micron Corp.), sieves of 53 μm, 45 μm and 38 μm are arranged in serial from the above, and 2 g of the electrophotographic toner (1) having been accurately weighed is put therein and applied with vibration with a magnitude of 1 mm for 90 seconds. The weights of the toner on the respective sieves after vibration are measured, which are summed with applying weights of 0.5, 0.3 and 1.0, respectively, followed by converted to a percentage, so as to obtain a powder aggregation degree. The sample (electrophotographic toner (1)) is used after allowing to stand in an environment of 45° C./50% RH for about 24 hours, and the measurement is carried out in an environment of 25° C./50%RH. The results are shown in Table 1.

In the invention, the powder aggregation property involves no problem upon practical use when the weight of the toner after the vibration is 40 or less, and preferably 30 or less.

Production of Carrier (1)

A film forming solution obtained by mixing a carbon dispersion obtained by adding 0.12 part by weight of carbon black (VXC-72, a trade name, produced by Cabot Inc.) to 1.25 parts by weight of toluene, followed by dispersing in a sand mill for 20 minutes, and 1.25 parts by weight of a 80% by weight ethyl acetate solution of a trifunctional isocyanate (Takenate D110N, produced by Takeda Chemical Industries, Ltd.), and 100 parts by weight of Mn—Mg—Sr ferrite particles (average particles diameter: 35 μm) are placed in a kneader/coater and agitated at ordinary temperature for 5 minutes, and the solvent is distilled off by increasing the temperature to 150° C. under normal pressure. After further agitating for 30 minutes, the heater is turned off to cool to 50° C. The resulting coated carrier is sieved by a 75 μm mesh to produce a carrier (1).

Measurement of Nitrogen Content on Surface of Carrier (1)

The nitrogen content in terms of percentage on the surface of the carrier (1) is calculated in such a manner that the carrier is measured by using Shimadzu X-ray Photoelectron Analyzer (ESCA-1000, produced by Shimadzu Corp.) at an X-ray output of 10 kV and 40 mA, and the proportions of elements are calculated from area intensities of element peaks of nitrogen (N, 1 s), silicon (Si, 2 p), carbon (C, 1 s) and oxygen (O, 1 s). The nitrogen content on the surface of the carrier (1) is 15.6% by atom.

Production of Electrophotographic Developer (1)

5 parts by weight of the electrophotographic toner (1) and 95 parts by weight of the carrier (1) are put in a V blender, and after agitating for 20 minutes, the mixture is sieved with a 105 μm mesh, so as to produce an electrophotographic developer (1).

Evaluation of Characteristics of Electrophotographic Developer (1)

Evaluation of Low Temperature Fixing Property

Image formation on a surface of recording paper is carried out by using the resulting electrophotographic developer (1) on a full color duplicator (A color, produced by Fuji Xerox Co., Ltd.) having a modified fixing device (with variable fixing temperatures), so as to evaluate the low temperature fixing property of the electrophotographic toner (1) contained in the electrophotographic developer (1). On the evaluation, the temperature is changed from 80° C. to 200° C. at an interval of 10° C. to obtain fixed images on the respective fixing temperatures, and the fixed images each is folded with the image surface inside to observe the extent of release of the image at the folded line. The lowest fixing temperature with substantially no release of the image is measured as the MFT (° C.), which is designated as the evaluation of the low temperature fixing property. The results are shown in Table 1.

When the fixing temperature is 130° C. or less, the low temperature fixing property is evaluated as being excellent.

The examination conditions for the low temperature fixing property are shown below.

Examination Conditions

Toner image: Solid image (40 mm×50 mm)

Toner amount: 0.4 mg/cm$^2$

Recording paper: Color copy paper (J paper) produced by Fuji Xerox Co., Ltd.

Transporting speed: 160 mm/sec

Nip width: 6.0 mm

Silicone oil coating amount: $1.6\times10^{-3}$ mg/cm$^2$

Evaluation of Storage Stability of Image

Two sheets of recording paper having fixed images formed at the lowest fixing temperature (MFG (° C.)) are accumulated with the image surfaces facing each other, and allowed to stand in an environment of a temperature of 60° C. and a humidity of 85% for 7 days with a load of 100 g/cm$^2$ being applied thereto. The accumulated images are then peeled from each other, and the presence of fusion of the images and transfer on the non-image part is observed with naked eye. The evaluation is carried out with the following standard. The results are shown in Table 1.

Evaluation Standard

A: No problem occurs in storage stability of the image.

B: Slight change is observed, but no practical problem occurs.

C: Great change is observed, and it is difficult to be subjected to practical use.

Evaluation of Charging Property, Fogging and Cloud

Evaluation of Charging Property

The electrophotographic developer (1) containing the electrophotographic toner (1) is installed in a full color duplicator (A color 935, produced by Fuji Xerox Co., Ltd.), and after idling for 3 minutes, the charge amount of the entire toner is measured by a blow off charge amount measuring apparatus (produced by Toshiba Corp.) using a mesh of 20 $\mu$m.

Thereafter, adjustment is conducted to obtain an image density of 1.5 after fixing an image of an image area ratio of 100% by using J paper (produced by Fuji Xerox Co., Ltd.), and then a continuous duplicating operation is carried out. The electrophotographic developer is sampled in the initial state and after supplying 3,000 sheets. By using the apparatus shown in FIG. 2, the electrophotographic toner in the electrophotographic developer is put (dropped) in the sample supplying tube 18, and the bottom value of the q/d value is measured by the CSG (charge spectrograph) method under the condition described in the foregoing.

All the evaluations of the charging property are carried out in an environment of 20° C./55%RH. The results are shown in Table 1.

Evaluation of Fogging

Samples in the initial stage and after duplicating 3,000 sheets in the continuous duplication for the charging property are evaluated with naked eye at the distance of 30 cm from the sample with the following standard. The results are shown in Table 1. The grades A and B are allowable.

A: No fogging is observed.

B: No fogging is observed from the distance of 30 cm, but slight fogging is found close observation.

C: Fogging is somewhat detected.

D: Fogging is remarkable.

E: Fogging is extremely remarkable.

Evaluation of Cloud

After duplicating 3,000 sheets in the continuous duplication for the charging property, it is allowed to stand in an environment of 28° C./85%RH for one week. The developing device is then idled for 3 minutes, and the visual evaluation is carried out with the following standard.

A: No contamination is found around the developing device.

B: Contamination is found around the developing device under close observation.

C: Contamination is clearly found around the developing device.

EXAMPLE 2

Synthesis of Crystalline Polyester Resin (2)

124 parts by weight of ethylene glycol, 22.2 parts by weight of sodium dimethyl 5-sulfoisophthalate, 213 parts by weight of dimethyl sebacate and 0.3 part by weight of dibutyl tin oxide as a catalyst are placed in a three-neck flask having been dried by heat, and the air inside the flask is replaced with a nitrogen gas by a pressure reduction operation to make an inert atmosphere, followed by stirring by mechanical stirring at 180° C. for 5 hours.

Thereafter, the temperature is gradually increased to 220° C. under reduced pressure, followed by stirring for 2 hours. When the content of the flask is in a viscous state, it is then cooled with air to terminate the reaction, so as to synthesize 220 parts by weight of a crystalline polyester resin (2).

The resulting crystalline polyester resin (2) is subjected to a molecular weight measurement by gel permeation chromatography (GPC) (polystyrene standard), and it has a weight average molecular weight (Mw) of 11,000 and a number average molecular weight (Mn) of 4,700.

The crystalline polyester resin (2) is measured for a melting point (Tm) by a differential scanning calorimeter (DSC) in the foregoing measurement method, and it has a clear peak, which has a peak top temperature of 69° C.

The content ratio of the copolymerization component (5-sulfoisophthalic acid component) and the sebacic acid component measured and calculated by an NMR spectrum of the resin is 7.5/92.5.

Production of Electrophotographic Toner (2)

Preparation of Resin Particle Dispersion (2) 150 parts by weight of the resulting crystalline polyester resin (2) is put in 850 parts by weight of distilled water, and the mixture is agitated by a homogenizer (Ultra-Turrax, produced by IKA Japan Co., Ltd.) under heating to 85° C., so as to obtain a resin particle dispersion (2).

Preparation of Aggregated Particles 2,400 parts by weight of the resin particle dispersion (2), 100 parts by weight of the coloring agent dispersion (1) obtained in Example 1, 63 parts by weight of a releasing agent particle dispersion, 10 parts by weight of lauroyl peroxide, 5 parts by weight of aluminum sulfate (produced by Wako Pure Chemical Industries, Ltd.) and 100 parts by weight of ion exchanged resin are placed in a stainless steel round flask and adjusted for pH to 2.0, and the mixture is dispersed by using a homogenizer (Ultra-Turax T50, produced by IKA Japan Co., Ltd.) and then heated to 63° C. over a heating oil bath under stirring. After maintaining at 63° C. for 3 hours, observation with an optical microscope confirms that aggregated particles having an average particle diameter of about 4.8 $\mu$m are formed. The stirring and heating is maintained for further 1 hour at 63° C., and then observation with an optical microscope confirms that aggregated particles having an average particle diameter of about 5.3 μm are formed.

Fusing Step

The aggregated particles have pH of 2.4. An aqueous solution obtained by diluting sodium carbonate (produced by Wako Pure Chemical Industries, Ltd.) to 0.5% by weight is gradually added thereto to adjust the pH to 5.0. Thereafter, the temperature is increased to 75° C. under continuous stirring, followed by maintaining for 3 hours.

Thereafter, the reaction product is filtered and sufficiently washed with ion exchanged water, and it is dried by using a vacuum drier, so as to obtain electrophotographic colored particles (2).

The resulting electrophotographic colored particles (2) are measured for an average particle diameter by using a Coulter Counter Type (TA-II) (produced by Beckman Coulter, Inc.), and it is found that the volume average particle diameter is 5.5 μm, and the number average particle diameter is 4.7 μm.

The resulting electrophotographic colored particles (2) are subjected to the same external addition treatment as in Example 1, so as to obtain an electrophotographic toner (2).

Evaluation of Physical Property of Electrophotographic Toner (2)

The electrophotographic toner (2) is subjected to evaluation of the physical property in the same manner as in the section of Evaluation of Physical Property of Electrophotographic Toner (1) in Example 1.

Production of Electrophotographic Developer (2)

5 parts by weight of the electrophotographic toner (2) and 95 parts by weight of the carrier (1) obtained in Example 1 are put in a V blender, and after agitating for 20 minutes, the mixture is sieved with a 105 μm mesh, so as to produce an electrophotographic developer (2).

Evaluation of Characteristics of Electrophotographic Developer (2)

The electrophotographic developer (2) is evaluated in the same manner as in the section of Evaluation of Characteristics of Electrophotographic Developer (1) in Example 1. The results are shown in Table 1.

EXAMPLE 3

Production of Carrier (2)

A film forming solution obtained by mixing a carbon dispersion obtained by adding 0.12 part by weight of carbon black (VXC-72, a trade name, produced by Cabot Inc.) to 0.66 part by weight of a 75% by weight toluene/butyl acetate solution of acrylic polyol and 1.25 parts by weight of toluene, followed by dispersing in a sand mill for 20 minutes, and 0.63 part by weight of a 80% by weight ethyl acetate solution of a trifunctional isocyanate (Takenate D110N, produced by Takeda Chemical Industries, Ltd.), and 100 parts by weight of Mn—Mg—Sr ferrite particles (average particle diameter: 35 μm) are placed in a kneader/coater and agitated at ordinary temperature for 5 minutes, and the solvent is distilled off by increasing the temperature to 150° C. under normal pressure. After further agitating for 30 minutes, the heater is turned off to cool to 50° C. The resulting coated carrier in sieved by a 75 μm mesh to produce a carrier (2).

Measurement of Nitrogen Content on Surface of Carrier (2)

The nitrogen content on the surface of the carrier (2) is obtained in the same manner as in the section of Measurement of Nitrogen Content on Surface of Carrier (1), and thus is 6.1% by atom.

Production of Electrophotographic Developer (3)

5 parts by weight of the electrophotographic toner (2) obtained in Example 2 and 95 parts by weight of the carrier (2) are put in a V blender, and after agitating for 20 minutes, the mixture is sieved with a 105 μm mesh, so as to produce an electrophotographic developer (3).

Evaluation of Characteristics of Electrophotographic Developer (3)

The electrophotographic developer (3) is evaluated in the same manner as in the section of Evaluation of Characteristics of Electrophotographic Developer (1) in Example 1. The results are shown in Table 1.

EXAMPLE 4

Production of Carrier (3)

11 parts by weight of silicone monool (molecular weight: 1,400) and 100 parts by weight of an adduct (trifunctional isocyanate) of hexamethylene diisocyanate and trimethylolpropane are mixed and heated, so as to obtain a silicone-modified isocyanate compound of a silicon modification amount of 10%.

A film forming solution obtained by mixing a carbon dispersion obtained by adding 0.12 part by weight of carbon black (VXC-72, a trade name, produced by Cabot Inc.) to 1.25 parts by weight of toluene, followed by dispersing in a sand mill for 20 minutes, and 1.25 parts by weight of a 80% by weight ethyl acetate solution of the silicone-modified isocyanate compound, and 100 parts by weight of Mn—Mg—Sr ferrite particles (average particle diameter: 35 μm) are placed in a kneader/coater and agitated at ordinary temperature for 5 minutes, and the solvent is distilled off by increasing the temperature to 150° C. under normal pressure. After further agitating for 30 minutes, the heater is turned off to cool to 50° C. The resulting coated carrier is sieved by a 75 μm mesh to produce a carrier (3).

Measurement of Nitrogen Content on Surface of Carrier (3)

The nitrogen content on the surface of the carrier (3) is obtained in the same manner as in the section of Measurement of Nitrogen Content on Surface of Carrier (1), and thus is 12.2% by atom.

Production of Electrophotographic Developer (3)

5 parts by weight of the electrophotographic toner (2) obtained in Example 2 and 95 parts by weight of the carrier (3) are put in a V blender, and after agitating for 20 minutes, the mixture is sieved with a 105 μm mesh, so as to produce an electrophotographic developer (4).

Evaluation of Characteristics of Electrophotographic Developer (4)

The electrophotographic developer (4) is evaluated in the same manner as in the section of Evaluation of Characteristics of Electrophotographic Developer (1) in Example 1. The results are shown in Table 1.

EXAMPLE 5

Production of Carrier (4)

A film forming solution obtained by mixing a carbon dispersion obtained by adding 0.12 part by weight of carbon black (VXC-72, a trade name, produced by Cabot Inc.) to 0.2 part by weight of a styrene/methyl methacrylate/hydroxyethyl methacrylate copolymer and 1.25 parts by weight of toluene, followed by dispersing in a sand mill for 20 minutes, and 1.67 parts by weight of a 60% by weight formaldehyde/butanol/toluene solution of butylated melamine, and 100 parts by weight of Mn—Mg—Sr ferrite particles (average particle diameter: 35 μm) are placed in a kneader/coater and agitated at ordinary temperature for 5 minutes, and the solvent is distilled off by increasing the temperature to 100° C. with stirring for 30 minutes under normal pressure. After further increasing the temperature to 200° C. and agitating for 30 minutes, the heater is turned off to cool to 50° C. The resulting coated carrier is sieved by a 75 μm mesh to produce a carrier (4).

Measurement of Nitrogen Content on Surface of Carrier (4)

The nitrogen content on the surface of the carrier (4) is obtained in the same manner as in the section of Measurement of Nitrogen Content on Surface of Carrier (1), and thus is 32.5% by atom.

Production of Electrophotographic Developer (5)

5 parts by weight of the electrophotographic toner (2) obtained in Example 2 and 95 parts by weight of the carrier (4) are put in a V blender, and after agitating for 20 minutes, the mixture is sieved with a 105 μm mesh, so as to produce an electrophotographic developer (5).

Evaluation of Characteristics of Electrophotographic Developer (5)

The electrophotographic developer (5) is evaluated in the same manner as in the section of Evaluation of Characteristics of Electrophotographic Developer (1) in Example 1. The results are shown in Table 1.

EXAMPLE 6

Production of Carrier (5)

After the temperature of a heat medium is increased to 220° C., 0.12 part by weight of carbon black (VXC-72, a trade name, produced by Cabot Inc.) is mixed with 1.2 parts by weight of nylon-12 pellets (melting point: 175° C.) in a Henschel mixer under heating and stirring, so as to fix the carbon black on the nylon. The nylon having carbon black fixed thereon is mixed with 100 parts by weight of Mn—Mg—Sr ferrite particles (average particle diameter: 35 μm) again in a Henschel mixer. The mixture is placed in a kneader/coater and agitated for 40 minutes under normal pressure while the temperature is increased to 220° C. Thereafter, the heater is turned off to cool to 50° C., followed by agitating for 50 minutes. The resulting coated carrier is sieved by a 75 μm mesh to produce a carrier (5).

Measurement of Nitrogen Content on Surface of Carrier (5)

The nitrogen content on the surface of the carrier (5) is obtained in the same manner as in the section of Measurement of Nitrogen Content on Surface of Carrier (1), and thus is 11.2% by atom.

Production of Electrophotographic Developer (6)

5 parts by weight of the electrophotographic toner (2) obtained in Example 2 and 95 parts by weight of the carrier (5) are put in a V blender, and after agitating for 20 minutes, the mixture is sieved with a 105 μm mesh, so as to produce an electrophotographic developer (6).

Evaluation of Characteristics of Electrophotographic Developer (6)

The electrophotographic developer (6) is evaluated in the same manner as in the section of Evaluation of Characteristics of Electrophotographic Developer (1) in Example 1. The results are shown in Table 1.

EXAMPLE 7

Synthesis of Crystalline Polyester Resin (3)

18.9 parts by weight of 1,20-eicosanediol, 1.3 parts by weight of sodium dimethyl 5 -sulfoisophthalate, 10 parts by weight of dimethyl sulfoxide and 0.03 part by weight of dibutyl tin oxide as a catalyst are placed in a three-neck flask having been dried by heat, and the air inside the flask is replaced with a nitrogen gas by a pressure reduction operation to make an inert atmosphere, followed by stirring by mechanical stirring at 180° C. for 3 hours. Dimethyl sulfoxide is distilled off under reduced pressure, and 15.9 parts by weight of dimethyl dodecanedioate is added thereto under a nitrogen stream, followed by stirring at 180° C. for 1 hours.

Thereafter, the temperature is gradually increased to 220° C. under reduced pressure, followed by stirring for 30 minutes. When the content of the flask is in a viscous state, it is then cooled with air to terminate the reaction, so as to synthesize 33 parts by weight of a crystalline polyester resin (3).

The resulting crystalline polyester resin (3) is subjected to a molecular weight measurement by gel permeation chromatography (GPC) (polystyrene standard), and it has a weight average molecular weight (Mw) of 10,200 and a number average molecular weight (Mn) of 6,100.

The crystalline polyester resin (3) is measured for a melting point (Tm) by a differential scanning calorimeter (DSC) in the foregoing measurement method, and it has a clear peak, which has a peak top temperature of 93° C.

The content ratio of the copolymerization component (5-sulfoisophthalic acid component) and the dodecanedioic acid component measured and calculated by an NMR spectrum of the resin is 7.7/92.3.

Production of Electrophotographic Toner (3)

Preparation of Resin Particle Dispersion (3)

150 parts by weight of the resulting crystalline polyester resin (3) is put in 850 parts by weight of distilled water, and the mixture is agitated by a homogenizer (Ultra-Turax, produced by IKA Japan Co., Ltd.) under heating to 99° C., so as to obtain a resin particle dispersion (3).

Preparation of Aggregated Particles 2,400 parts by weight of the resin particle dispersion (3), 100 parts by weight of the coloring agent dispersion (1) obtained in Example 1, 63 parts by weight of a releasing agent particle dispersion, 10 parts by weight of lauroyl peroxide, 5 parts by weight of aluminum sulfate (produced by Wako Pure Chemical Industries, Ltd.) and 100 parts by weight of ion exchanged resin are placed in a stainless steel round flask and adjusted for pH to 2.0, and the mixture is dispersed by using a homogenizer (Ultra-Turax T50, produced by IKA Japan Co., Ltd.) and then heated to 88° C. over a heating oil bath under stirring. After maintaining at 88° C. for 3 hours, observation with an optical microscope confirms that aggregated particles having an average particle diameter of about 4.2 μm are formed. The stirring and heating is maintained for further 1 hour at 88° C., and then observation with an optical microscope confirms that aggregated particles having an average particle diameter of about 5.2 μm are formed.

Fusing Step

The aggregated particles have pH of 2.4. An aqueous solution obtained by diluting sodium carbonate (produced by Wako Pure Chemical Industries, Ltd.) to 0.5% by weight is gradually added thereto to adjust the pH to 5.0. Thereafter, the temperature is increased to 97° C. under continuous stirring, followed by maintaining for 3 hours.

Thereafter, the reaction product is filtered and sufficiently washed with ion exchanged water, and it is dried by using a vacuum drier, so as to obtain electrophotographic colored particles (3).

The resulting electrophotographic colored particles (3) are measured for an average particle diameter by using a Coulter Counter Type (TA-II) (produced by Beckman Coulter, Inc.), and it is found that the volume average particle diameter is 5.5 μm, and the number average particle diameter is 4.7 μm.

The resulting electrophotographic colored particles (3) are subjected to the same external addition treatment as in Example 1, so as to obtain an electrophotographic toner (3).

Evaluation of Physical Property of Electrophotographic Toner (3)

The electrophotographic toner (3) is subjected to evaluation of the physical property in the same manner as in the section of Evaluation of Physical Property of Electrophotographic Toner (1) in Example 1.

Production of Electrophotograhic Developer (7)

5 parts by weight of the electrophotographic toner (3) and 95 parts by weight of the carrier (1) obtained in Example 1 are put in a V blender, and after agitating for 20 minutes, the mixture is sieved with a 105 μm mesh, so as to produce an electrophotographic developer (7).

Evaluation of Characteristics of Electrophotographic Developer (7)

The electrophotographic developer (7) is evaluated in the same manner as in the section of Evaluation of Characteristics of Electrophotographic Developer (1) in Example 1. The results are shown in Table 1.

COMPARATIVE EXAMPLE 1

Synthesis of Crystalline Polyester Resin (4)

90.1 parts by weight of 1,4-butanediol, 22.2 parts by weight of sodium dimethyl 5-sulfoisophthalate, 161.1 parts by weight of dimethyl adipate and 0.3 part by weight of dibutyl tin oxide as a catalyst are placed in a three-neck flask having been dried by heat, and the air inside the flask is replaced with a nitrogen gas by a pressure reduction operation to make an inert atmosphere, followed by stirring by mechanical stirring at 180° C. for 3 hours.

Thereafter, the temperature is gradually increased to 220° C. under reduced pressure, followed by stirring for 2 hours. When the content of the flask is in a viscous state, it is then cooled with air to terminate the reaction, so as to synthesize 220 parts by weight of a crystalline polyester resin (4).

The resulting crystalline polyester resin (4) is subjected to a molecular weight measurement by gel permeation chromatography (GPC) (polystyrene standard); and it has a weight average molecular weight (Mw) of 11,000 and a number average molecular weight (Mn) of 4,700.

The crystalline polyester resin (4) is measured for a melting point (Tm) by a differential scanning colorimeter (DSC) in the foregoing measurement method, and it has a clear peak, which has a peak top temperature of 55° C.

The content ratio of the copolymerization component (5-sulfoisophthalic acid component) and the adipic acid component measured and calculated by an NMR spectrum of the resin is 7.5/92.5.

Production of Electrophotographic Toner (4)

Preparation of Resin Particle Dispersion (4)

150 parts by weight of the resulting crystalline polyester resin (4) is put in 850 parts by weight of distilled water, and the mixture is agitated by a homogenizer (Ultra-Turax, produced by IKA Japan Co., Ltd.) under heating to 99° C. so as to obtain a resin particle dispersion (4).

Preparation of Aggregated Particles 2,400 parts by weight of the resin particle dispersion (4), 100 parts by weight of the coloring agent dispersion (1) obtained in Example 1, 63 parts by weight of a releasing agent particle dispersion, 10 parts by weight of lauroyl peroxide, 5 parts by weight of aluminum sulfate (produced by Wako Pure Chemical Industries, Ltd.) and 100 parts by weight of ion exchanged resin are placed in a stainless steel round flask and adjusted for pH to 2.0, and the mixture is dispersed by using a homogenizer (Ultra-Turax T50, produced by IKA Japan Co., Ltd.) and then heated to 50° C. over a heating oil bath under stirring. After maintaining at 50° C. for 3 hours, observation with an optical microscope confirms that aggregated particles having an average particle diameter of about 4.8 μm are formed. The stirring and heating is maintained for further 1 hours at 50° C., and then observation with an optical microscope confirms that aggregated particles having an average particle diameter of about 5.4 μm are formed.

Fusing Step

The aggregated particles have pH of 2.4. An aqueous solution obtained by diluting sodium carbonate (produced by Wako Pure Chemical Industries, Ltd.) to 0.5% by weight is gradually added thereto to adjust the pH to 5.0. Thereafter, the temperature is increased to 65° C. under continuous stirring, followed by maintaining for 3 hours.

Thereafter, the reaction product is filtered and sufficiently washed with ion exchanged water, and it is dried by using a vacuum drier, so as to obtain electrophotographic colored particles (4).

The resulting electrophotographic colored particles (4) are measured for an average particle diameter by using a Coulter Counter Type (TA-II) (produced by Beckman Coulter, Inc.), and it is found that the volume average particle diameter is 5.5 μm, and the number average particle diameter is 4.7 μm.

The resulting electrophotographic colored particles (4) are subjected to the same external addition treatment as in Example 1, so as to obtain an electrophotographic toner (4).

Evaluation of Physical Property of Electrophotographic Toner (4)

The electrophotographic toner (4) is subjected to evaluation of the physical property in the same manner as in the section of Evaluation of Physical Property of Electrophotographic Toner (1) in Example 1.

Production of Electrophotographic Developer (8)

5 parts by weight of the electrophotographic toner (4) and 95 parts by weight of the carrier (1) obtained in Example 1 are put in a V blender, and after agitating for 20 minutes, the mixture is sieved with a 105 μm mesh, so as to produce an electrophotographic developer (8).

Evaluation of Characteristics of Electrophotographic Developer (8)

The electrophotographic developer (8) is evaluated in the same manner as in the section of Evaluation of Characteristics of Electrophotographic Developer (1) in Example 1. The results are shown in Table 1.

COMPARATIVE EXAMPLE 2

Synthesis of Amorphous Polyester Resin (1)

35 parts by mole of polyoxyethylene(2,0)-2,2-bis(4-hydroxyphenyl)propane, 65 parts by mole of polyoxypropylene(2,2)-2,2-bis(4-hydroxyphenyl)propane, 80 parts by mole of terephthalic acid, 10 parts by mole of n-dodecenylsuccinic acid, 10 parts by weight of trimellitic acid and 0.05 part by mole, with respect to the acid components 0 of dibutyl tin oxide are placed in a two-neck flask having been dried by heat, and a nitrogen gas is introduced into the interior of the flask to maintain an inert atmosphere. The temperature is increased, and the copolycondensation reaction is carried out at a temperature of from 150 to 230° C. for about 12 hours. Thereafter, the pressure is gradually reduced at a temperature of from 210 to 250° C., so as to synthesize an amorphous polyester resin (1).

The molecular weight measurement by gel permeation chromatography (polystyrene standard) reveals that the amorphous polyester resin (1) has a weight average molecular weight (Mw) of 15,400 and a number average molecular weight (Mn) of 6,800.

A DSC spectrum of the amorphous polyester resin (1) is measured by using a differential scanning calorimeter (DSC) in the same manner as in the measurement of the melting point (Tm) described in the foregoing, and it does not show any clear peak, but stepwise change in endothermic amount is observed. The glass transition point as a midway point of the stepwise change in endothermic amount is 65° C.

Production of Electrophotographic Toner (5) (Dissolution and Suspension)

86 parts by weight of the resulting amorphous polyester resin (1) and 16 parts by weight of a copper phthalocyanine pigment (C.I. Pigment Blue 15:3) are melted and mixed by using a Banbury kneader/mixer, so as to obtain a colored resin composition of a high concentration. 25 parts by weight of the colored resin composition and 75 parts by weight of the amorphous polyester resin (1) are dispersed and dissolved in 100 parts by weight of ethyl acetate to prepare a dispersed solution.

The resulting dispersed solution is added to a mixed liquid of 1 part by weight of carboxymethyl cellulose, 20 parts by weight of calcium carbonate and 100 parts by weight of water, and dispersed by agitating at a high speed by using a mixer, so as to obtain an emulsion. The emulsion is put in a beaker, to which about five times amount of water is added, and is maintained in a warm bath at 43° C. for 10 hours under stirring, so as to evaporate the ethyl acetate. 10%-Hydrochloric acid is added thereto to dissolve calcium carbonate with hydrochloric acid, and washing with water is repeated to obtain a mixture of water and a toner. Finally, water is evaporated by a freeze drying machine, so as to produce an electrophotographic colored particles (5).

The resulting electrophotographic colored particles (5) are measured for an average particle diameter by using a Coulter Counter Type (TA-II) (produced by Beckman Coulter, Inc.), and it is found that the volume average particle diameter is 5.5 μm, and the number average particle diameter is 4.7 μm.

The resulting electrophotographic colored particles (5) are subjected to the same external addition treatment as in Example 1, so as to obtain an electrophotographic toner (5).

Evaluation of Physical Property of Electrophotographic Toner (5)

The electrophotographic toner (5) is subjected to evaluation of the physical property in the same manner as in the section of Evaluation of Physical Property of Electrophotographic Toner (1) in Example 1.

Production of Electrophotographic Developer (9)

7 parts by weight of the electrophotographic toner (5) and 93 parts by weight of the carrier (2) obtained in Example 3 are put in a V blender, and after agitating for 20 minutes, the mixture is sieved with a 105 μm mesh, so as to produce an electrophotographic developer (9).

Evaluation of Characteristics of Electrophotographic Developer (9)

The electrophotographic developer (9) is evaluated in the same manner as in the section of Evaluation of Characteristics of Electrophotographic Developer (1) in Example 1. The results are shown in Table 1.

COMPARATIVE EXAMPLE 3

Production of Carrier (6)

A film forming solution obtained by mixing 0.12 part by weight of carbon black (VXC-72, a trade name, produced by Cabot Inc.) with 1.5 parts by weight of a styrene/methyl methacrylate copolymer and 10 parts by weight of toluene, followed by dispersing in a sand mill for 20 minutes, and 100 parts by weight of Mn—Mg—Sr ferrite particles (average particle diameter: 35 μm) are placed in a kneader/coater and heated to 70° C., followed by agitating for 30 minutes, and the solvent is distilled off under reduced pressure. The resulting coated carrier is sieved by a 75 μm mesh to produce a carrier (6).

Measurement of Nitrogen Content on Surface of Carrier (6)

The nitrogen content on the surface of the carrier (6) is obtained in the same manner as in the section of Measurement of Nitrogen Content on Surface of Carrier (1), and thus is 0% by atom.

Production of Electrophotographic Developer (10)

5 parts by weight of the electrophotographic toner (2) obtained in Example 2 and 95 parts by weight of the carrier (6) are put in a V blender, and after agitating for 20 minutes, the mixture is sieved with a 105 μm mesh, so as to produce an electrophotographic developer (10).

Evaluation of Characteristics of Electrophotographic Developer (10)

The electrophotographic developer (10) is evaluated in the same manner as in the section of Evaluation of Characteristics of Electrophotographic Developer (1) in Example 1. The results are shown in Table 1.

COMPARATIVE EXAMPLE 4

Production of Carrier (7)

A film forming solution obtained by mixing 0.12 part by weight of carbon black (VXC-72, a trade name, produced by Cabot Inc.) with 5 parts by weight of a thermosetting silicone resin 0, followed by dispersing in a sand mill for 20 minutes, and 100 parts by weight of Mn—Mg—Sr ferrite particles (average particle diameter: 35 μm) are placed in a kneader/coater and are mixed at room temperature and normal pressure for 15 minutes, and the solvent is then distilled off by heating at reduced pressure under stirring. It is then further heated and mixed at 200° C. for 60 minutes, followed by cooling to ordinary temperature. The resulting coated carrier is sieved by a 75 μm mesh to produce a carrier (7).

Measurement of Nitrogen Content on Surface of Carrier (7)

The nitrogen content on the surface of the carrier (7) is obtained in the same manner as in the section of Measurement of Nitrogen Content on Surface of Carrier (1), and thus is 0% by atom.

Production of Electrophotographic Developer (11)

5 parts by weight of the electrophotographic toner (2) obtained in Example 2 and 95 parts by weight of the carrier (7) are put in a V blender, and after agitating for 20 minutes, the mixture is sieved with a 105 μm mesh, so as to produce an electrophotographic developer (11).

Evaluation of Characteristics of Electrophotographic Developer (11)

The electrophotographic developer (11) is evaluated in the same manner as in the section of Evaluation of Characteristics of Electrophotographic Developer (1) in Example 1. The results are shown in Table 1.

TABLE 1

| Example | Ex. 1 | Ex. 2 | Ex. 3 | Ex. 4 | Ex. 5 | Ex. 6 | Ex. 7 | Comp. Ex. 1 | Comp. Ex. 2 | Comp. Ex. 3 | Comp. Ex. 4 |
|---|---|---|---|---|---|---|---|---|---|---|---|
| Electrophotographic toner | 1 | 2 | 2 | 2 | 2 | 2 | 3 | 4 | 5 | 2 | 2 |
| Carrier | 1 | 1 | 2 | 3 | 4 | 5 | 1 | 1 | 1 | 6 | 7 |
| Nitrogen content on surface of carrier (% by atom) | 15.6 | 15.6 | 6.1 | 12.2 | 32.5 | 11.2 | 15.6 | 15.6 | 15.6 | 0 | 0 |

TABLE 1-continued

| Example | | Ex. 1 | Ex. 2 | Ex. 3 | Ex. 4 | Ex. 5 | Ex. 6 | Ex. 7 | Comp. Ex. 1 | Comp. Ex. 2 | Comp. Ex. 3 | Comp. Ex. 4 |
|---|---|---|---|---|---|---|---|---|---|---|---|---|
| Viscoelasticity | T1 (° C.) | 76 | 67 | 67 | 67 | 67 | 88 | 54 | 63 | 67 | 67 | 67 |
| (sharp melt property) | T2 (° C.) | 78 | 68 | 68 | 68 | 68 | 90 | 55 | 115 | 68 | 68 | 68 |
| Powder aggregation property | | 12 | 15 | 15 | 15 | 15 | 15 | 11 | 18 | 22 | 15 | 15 |
| Low temperature fixing property (MFT) (° C.) | | 110 | 90 | 90 | 90 | 90 | 90 | 120 | 80 | 160 | 90 | 90 |
| Storage stability of fixed image | | A | A | A | A | A | A | A | C | B | A | A |
| Charge amount (initial stage) (μC/g) | | 55 | 53 | 46 | 42 | 62 | 60 | 57 | 45 | 90 | 18 | 9 |
| Bottom value of q/d value | Initial stage | −0.36 | −0.324 | −0.27 | −0.225 | −0.36 | −0.378 | −0.81 | −0.63 | +0.18 | +0.45 | −0.324 |
| | After 3,000 sheets duplication | −0.324 | −0.297 | −0.243 | −0.207 | −0.324 | −0.36 | −0.45 | −0.585 | +0.45 | +1.08 | −0.306 |
| Fogging | Initial stage | A | A | A | A | A | A | A | A | D | E | A |
| | After 3,000 sheets duplication | A | A | A | A | A | A | B | A | E | E | A |
| Cloud | After 3,000 sheets duplication | A | A | A | A | A | A | A | A | C | C | A |

TABLE 2

| Electrophotographic toner | $G_L$ at 30° C. (Pa) | $G_N$ at 30° C. (Pa) |
|---|---|---|
| Electrophotographic toner (1) | $9 \times 10^7$ | $1 \times 10^7$ |
| Electrophotographic toner (2) | $1 \times 10^8$ | $2 \times 10^7$ |
| Electrophotographic toner (3) | $2 \times 10^8$ | $2 \times 10^7$ |
| Electrophotographic toner (4) | $8 \times 10^7$ | $9 \times 10^6$ |
| Electrophotographic toner (5) | $1 \times 10^9$ | $5 \times 10^7$ |

It is understood from the results shown in Table 1 that the electrophotographic toners (1) to (4) in Examples 1 to 7 and Comparative Examples 1, 3 and 4 have an extremely small difference between T1 and T2 of 5° C. or less and exhibit sharp change in viscoelasticity with respect to temperature owing to the crystallinity of the crystalline polyester resins. On the other hand, the amorphous electrophotographic toner (5) in Comparative Example 2 has a difference between T1 and T2 of about 50° C. and exhibits such a behavior that the viscoelasticity is gradually decreased with the increase of temperature from the vicinity of the glass transition point.

In the measurement and evaluation of the powder aggregation property (toner blocking resistance), all the electrophotographic toners (1) to (5) in Examples 1 to 7 and Comparative Examples 1 to 4 exhibit good powder aggregation property.

In the evaluation of the low temperature fixing property, the electrophotograhic toners (1) to (4) are fixed at sufficiently low temperatures in comparison to 160° C. for the conventional amorphous electrophotographic toner (5), and exhibit good fixing property as the release of the folded image is substantially not found.

In the evaluation of the storage stability of the fixed images, the electrophotographic toners (1) to (3) in Examples 1 to 7 and Comparative Examples 3 and 4 cause substantially no problem of fusion of images and transfer to the non-image area of the counter part. However, the electrophotographic toner (4) in Comparative Example 1 causes remarkable fusion of images and transfer to the non-image area of the counter part owing to the low melting point thereof. The amorphous electrophotographic toner (5) in Comparative Example 2 causes some extent of fusion of images and transfer to the non-image area of the counter part owing to the glass transition point of 65° C.

In the evaluation of the charging property, Examples 1 to 7 and Comparative Examples 1 and 2 show good charge amounts, but Comparative Examples 3 and 4 exhibit low charge amounts because no nitrogen is contained. Upon the CSG measurement, Examples 1 to 7 and Comparative Examples 1 and 2 show sufficiently low bottom values of the q/d value, but it is understood that positively charged (inverse polarity) toners are present in Comparative Examples 3 and 4.

In the evaluation of the fogging and the cloud, Examples 1 to 7 and Comparative Examples 1 and 2 cause no problem since they exhibit sufficiently charging property and sufficient bottom values of the q/d value in the CSG measurement, but Comparative Examples 3 and 4 cannot provide sufficient charge amounts owing to the carrier containing no nitrogen, and cause remarkable fogging and could due to the presence of the toners of the inverse polarity as confirmed by the CSG measurement.

It is understood from the foregoing results as follows. Examples 1 to 7 show remarkable low temperature fixing property in comparison to the conventional products and show good charging property, and therefore, they cause no problem in fogging and could. Furthermore, no problem is caused in storage stability of the image after fixing. On the other hand, Comparative Example 1 causes no problem in low temperature fixing property, fogging and cloud, but causes a problem in storage stability of the image after fixing. Comparative Example 2, which uses the conventional toner, is insufficient in low temperature fixing property. Comparative Examples 3 and 4 are sufficient in low temperature fixing property, but cannot provide sufficient charge amounts owing to the carriers containing no nitrogen, so as to bring about problems in fogging and cloud.

As described in the foregoing, the invention can provide an electrophotographic toner and a process for forming an image that are excellent in low temperature fixing property and also are excellent in toner blocking resistance, storage stability of an image after fixing, and charging property.

What is claimed is:

1. An electrophotographic developer comprising a toner for developing an electrostatic image and a carrier, wherein the toner contains a colorant and a binder resin, the resin containing a crystalline resin having a melting point of about from 60° C. to 120° C. as a main component, and the carrier has a resin coating containing a nitrogen-containing resin, and wherein the toner has a storage elastic modulus $G_L(30)$ of $1\times10^6$ Pa or more and a loss elastic modulus $G_N(30)$ of $1\times10^6$ Pa or more at an angular frequency of 1 rad/sec and 30° C.

2. The electrophotographic developer as claimed in claim 1, wherein the toner has an absolute value of a bottom value of a q/d value of about from 0.009 to 18, where q represents a charge amount (fC) of the toner, and d represents a particle diameter ($\mu$m) of the toner.

3. The electrophotographic developer as claimed in claim 1, wherein the carrier has a nitrogen content on a surface thereof of about from 0.1% to 50% by atom.

4. The electrophotographic developer as claimed in claim 1, wherein the resin coating contains a resin selected from a urethane resin, a melamine resin and an amide resin.

5. The electrophotographic developer as claimed in claim 1, wherein the carrier has electroconductive fine powder in the resin coating.

6. The electrophotographic developer as claimed in claim 1, wherein the carrier has a volume average particle diameter of about from 10 $\mu$m to 150 $\mu$m.

7. The electrophotographic developer as claimed in claim 1, wherein the carrier has an electric resistance of about from $10^9$ Ω·cm to $10^{14}$ Ω·cm.

8. The electrophotographic developer as claimed in claim 1, wherein the carrier has an average thickness of the resin film of about from 0.1 $\mu$m to 10 $\mu$m, calculated by the following equation:

$$\text{Average thickness}=(1/6)\cdot(D\cdot\rho_D\cdot W_C/\rho_C)$$

where $\rho_D$ represents a specific gravity of a carrier core material, D represents an average particle diameter of the carrier core material, $\rho_C$ represents an average specific gravity of the coated resin, and $W_C$ represents a total coated amount of the resin.

9. The electrophotographic developer as claimed in claim 1, wherein the electrophotographic toner and the carrier are mixed by a ratio of about from 1/100 to 30/100.

10. The electrophotographic developer as claimed in claim 1, wherein the values of the storage elastic modulus $G_L$ and the loss elastic modulus $G_N$ have an area which is changed by $10^2$ or more within a temperature range of 10° C.

11. The electrophotographic developer as claimed in claim 1, wherein the binder resin contains the crystalline resin in an amount of about 70% by weight or more.

12. The electrophotographic developer as claimed in claim 1, wherein the crystalline resin in the toner is a crystalline polyester resin.

13. The electrophotographic developer as claimed in claim 12, wherein the crystalline polyester resin is synthesized from an acid component and an alcohol component, the acid component containing an aromatic dicarboxylic acid or an aliphatic dicarboxylic acid.

14. The electrophotographic developer as claimed in claim 12, wherein the crystalline polyester resin is synthesized from an acid component and an alcohol component, the alcoholic component containing an aliphatic diol.

15. The electrophotographic developer as claimed in claim 12, wherein the crystalline polyester resin is synthesized from an acid component and an alcohol component, and at least one of the acid component and the alcohol component contains a component having a double bond.

16. The electrophotographic developer as claimed in claim 12, wherein the crystalline polyester resin is synthesized from an acid component and an alcohol component, and at least one of the acid component and the alcohol component contains a component having a sulfonic acid group.

17. The electrophotographic developer as claimed in claim 13, wherein the aromatic dicarboxylic acid component and the aliphatic dicarboxylic acid component are in an amount of about from 80% to 99% by constitution with respect to a total amount of the acid components.

18. The electrophotographic developer as claimed in claim 14, wherein the aliphatic diol component is in an amount of about 80% to 99% by constitution with respect to a total amount of the alcohol components.

19. A process for forming an image comprising the steps of:

forming an electrostatic latent image on a latent image bearing member;

developing the electrostatic latent image formed on the latent image bearing member with a developer carried on a developer bearing member to form a toner image;

transferring the toner image formed on the latent image bearing member to a transfer material; and fixing the toner image transferred to the transfer material with heat, wherein the developer is an electrophotographic developer comprising a toner for developing an electrostatic image and a carrier, wherein the toner contains a colorant and a binder resin, the resin containing a crystalline resin having a melting point of about from 60° C. to 120° C. as a main component, and the carrier has a resin coating containing a nitrogen-containing resin, and wherein the toner has a storage elastic modulus $G_L(30)$ of $1\times10^6$ Pa or more and a loss elastic modulus $G_N(30)$ of $1\times10^6$ Pa or more at an angular frequency of 1 rad/sec and 30° C.

* * * * *